US007174112B2

(12) United States Patent
Motohashi et al.

(10) Patent No.: US 7,174,112 B2
(45) Date of Patent: Feb. 6, 2007

(54) IMAGE FORMING APPARATUS FEATURING A TRANSFER BIAS HAVING A POLARITY OPPOSITE TO A POLARITY OF A CHARGED TONER

(75) Inventors: Satoru Motohashi, Chiba (JP); Satoshi Sunahara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/326,188

(22) Filed: Jan. 6, 2006

(65) Prior Publication Data

US 2006/0120743 A1 Jun. 8, 2006

Related U.S. Application Data

(62) Division of application No. 10/784,936, filed on Feb. 25, 2004.

(30) Foreign Application Priority Data

Feb. 27, 2003 (JP) ..... 2003-051722
Feb. 27, 2003 (JP) ..... 2003-051727

(51) Int. Cl.
*G03G 15/16* (2006.01)

(52) U.S. Cl. ..... 399/66

(58) Field of Classification Search ..... 399/50, 399/100, 168, 174, 175, 176, 66, 101, 314
See application file for complete search history.

(56) References Cited

U.S. PATENT DOCUMENTS 4,851,960 A 7/1989 Nakamura et al. ..... 361/225

(Continued)

FOREIGN PATENT DOCUMENTS

JP 63-149669 6/1988

(Continued)

*Primary Examiner*—Robert Beatty
(74) *Attorney, Agent, or Firm*—Fitzpatrick, Cella, Harper & Scinto

(57) ABSTRACT

An image forming apparatus includes a rotatable latent image bearing member; a charging device contacting with the latent image bearing member and being provided with a voltage applied thereto for charging the latent image bearing member; a cleaning device contacting with the latent image bearing member for cleaning the latent image bearing member; and a transfer device contacting with the latent image bearing member and being provided with a transfer voltage for transferring, to a transfer medium, an image developed with a developer in an image forming area. The charging device, when in contact with an area constituting an image forming area of the latent image bearing member, is provided with an AC voltage for charging a non-image forming area having a peak-to-peak voltage larger than a peak-to-peak voltage of a charging AC voltage applied to the charging device for charging an area constituting the image forming area. When an area of the latent image bearing member, charged by the AC voltage for charging the non-image forming area applied to the charging device, comes into contact with the transfer device, a DC voltage of a polarity opposite to a normal charging polarity of the latent image bearing member is applied to the transfer device. More specifically, the transfer voltage is determined based on the DC voltage. The transfer voltage is determined, based on a current flowing between the latent image bearing member and the transfer means when the DC voltage is applied to the transfer means.

8 Claims, 20 Drawing Sheets

U.S. PATENT DOCUMENTS

| | | | | |
|---|---|---|---|---|
| 5,420,671 | A | 5/1995 | Kisu et al. | 355/219 |
| 5,715,499 | A * | 2/1998 | Yamazaki et al. | 399/50 |
| 5,717,979 | A | 2/1998 | Senba et al. | 399/50 |
| 5,839,026 | A | 11/1998 | Ko | 399/100 |
| 6,118,952 | A * | 9/2000 | Furuya | 399/50 |
| 6,640,063 | B2 * | 10/2003 | Adachi et al. | 399/50 |
| 6,735,402 | B2 * | 5/2004 | Oki | 399/66 |
| 6,882,806 | B2 * | 4/2005 | Sunahara et al. | 399/50 |
| 2001/0019669 | A1 | 9/2001 | Watanabe et al. | 399/50 |
| 2001/0026694 | A1 * | 10/2001 | Sakaizawa et al. | 399/50 |
| 2003/0219268 | A1 | 11/2003 | Sunahara et al. | 399/50 |

FOREIGN PATENT DOCUMENTS

JP 2000010364 A * 1/2000

* cited by examiner

FIG. 19

| | DISCHARGED CURRENT VALUE | | PHOTOSENSITIVE DRUM LIFE |
|---|---|---|---|
| | δa | δb | |
| EMBODIMENT 4 | 3260 | 1280 | 7000 SHEETS |
| COMPARISON EXAMPLE 4-1 | 1280 | 1280 | 7300 SHEETS |
| COMPARISON EXAMPLE 4-2 | 3260 | 3260 | 5400 SHEETS |

IMAGE FORMING APPARATUS FEATURING A TRANSFER BIAS HAVING A POLARITY OPPOSITE TO A POLARITY OF A CHARGED TONER

CROSS-REFERENCE TO RELATED APPLICATION

This application is a divisional Application No. 10/784,936, filed Feb. 25, 2004.

BACKGROUND OF THE INVENTION

1. Field of the Invention

The present invention relates to an image forming apparatus utilizing an electrophotographic process, an electrostatic recording process etc.

2. Related Background Art (1) Image Forming Process

An image forming apparatus is generally provided, as shown in FIG. 8, with a photosensitive drum 10 constituting a latent image bearing member, a charging apparatus 11 constituting charging means which uniformly charges the photosensitive drum, an exposure apparatus 12 for applying an imagewise exposure to the uniformly charged photosensitive drum thereby forming an electrostatic latent image, a developing apparatus 13 for developing the electrostatic latent image with a toner, constituting a developer, thereby obtaining a visible toner image, a transfer apparatus 15 constituting transfer means which transfers the toner image, present on the photosensitive drum, onto a transfer material 14 constituting a transfer medium, a fixing apparatus 16 for fixing the toner image on the transfer material, and a cleaning apparatus 17 constituting cleaning means which scrapes off toner remaining on the photosensitive drum 10. The photosensitive drum 10, the charging apparatus 11, the developing apparatus 13 and the cleaning apparatus 17 are often constructed as a process cartridge, detachably mounted on a main body of the image forming apparatus.

The image forming apparatus executes an image formation by repeating the steps of charging, exposure, development, transfer, fixation and cleaning with the above-mentioned means.

(2) Operation Sequence of Image Forming Apparatus

FIG. 9 shows a general operation sequence of an image forming apparatus. When a detachable process cartridge is inserted into a main body of the image forming apparatus and a power supply therein is turned on, a main motor is activated to initiate an initial multi-rotation step. This step executes a detection of presence/absence of the process cartridge, and a cleaning of a transfer roller (toner attached on the transfer roller being discharged onto the photosensitive drum).

After the initial multi-rotation step, the image forming apparatus moves a stand-by state. When image information is supplied from output means such as an unillustrated host computer to the image forming apparatus, the main motor drives the main body of the image forming apparatus thereby entering an initial rotation step. This step executes preparatory operations for printing in various process devices, principally including a preliminary charging of the photosensitive drum, a stan-up of a laser scanner, a determination of a transfer voltage in the image formation, and a temperature regulation of the fixing apparatus.

After the initial multi rotation step, the image forming apparatus moves a stand-by state. When image information is supplied from output means such as an unillustrated host computer to the image forming apparatus, the main motor drives the main body of the image forming apparatus thereby entering an initial rotation step. This step executes preparatory operations for printing in various process devices, principally including a preliminary charging of the photosensitive drum, a start-up of a laser scanner, a determination of a transfer voltage in the image formation, and a temperature regulation of the fixing apparatus.

After the initial rotation step, an image forming step is initiated, including a supply of a transfer material at a predetermined timing, an imagewise exposure on the photosensitive drum, a development, a transfer, a fixation etc.

After the image forming step, in case a next print signal is present, there is entered an intersheet step for awaiting a next printing operation until a next transfer material arrives. In case of absence of a next print signal, the image forming apparatus enters a post-rotation step, which executes a charge elimination of the surface of the photosensitive drum, and a cleaning of the transfer roller.

When the post-rotation step is completed, the image forming apparatus enters a stand-by state again, thus waiting for a next print signal.

(3) Charging Apparatus and Control Method for Charging Bias Voltage

For the charging apparatus 11, there is widely employed a contact charging method of maintaining a charging apparatus of a roller or a blade in contact with the surface of the photosensitive drum and applying a voltage to the charging apparatus thereby charging the surface of the photosensitive drum. In particular, the charging method of roller type can achieve a stable charging over a prolonged period.

A charging bias voltage source applies a charging bias voltage to the charging apparatus. The charging on the photosensitive drum may be achieved by a charging bias voltage constituted solely of a direct current voltage, but there is generally employed a bias voltage, as disclosed in Japanese Patent Application Laid-open No. 63-149669, formed by superposing a direct current voltage Vdc corresponding to a desired dark potential Vd on the drum with an alternating current voltage having a peak-to-peak voltage (Vpp) equal to or higher than two times of a discharge starting voltage under a direct current voltage application. (In the following, a direct current is represented by DC, an alternating current is represented by AC, and the above-described charging method is represented as AC+DC charging.)

This charging method is suitable for uniformly charging the surface of the photosensitive drum 10. By superposing the DC voltage with an AC voltage equal to or higher than a certain level, a local potential unevenness (charging failure) on the photosensitive drum is eliminated by a leveling effect of the AC voltage, whereby a charged potential Vd on the surface of the photosensitive drum uniformly converges to DC voltage Vdc.

The AC+DC charging is characterized in having a larger discharge current to the photosensitive drum, in comparison with a DC charging in which a DC voltage alone is applied. With an increase in the discharge current to the photosensitive drum, a chain connecting molecules on the surface of the photosensitive drum tends to become more easily cleavable. Consequently a resin constituting the surface of the photosensitive drum is modified toward a lower molecular weight, and becomes more easily scrapable with a cleaning blade. Therefore the surface of the photosensitive drum is polished and can enter a next image formation (charging step), even after repeated use, in a refreshed state as in an initial stage of use without a surface contamination for example by a transfer residual toner.

However, in case an excessive discharge current continues to be applied to the surface of the photosensitive drum, a surface layer of the photosensitive drum is scraped off with a higher speed, whereby the photosensitive layer of the photosensitive drum reaches a limit film thickness where the photosensitive layer can no longer exhibit its function in an early stage after the start of use, thus coming to the end of the service life. Upon reaching such limit film thickness, the photosensitive layer loses its function, thus exhibiting a small unevenness in the charging, or generating a charging failure as a result of a loss in the charge holding ability of the surface. In the actual use, therefore, the discharge current to the surface of the photosensitive drum has to be so regulated as not to become excessively large.

A relation between a peak-to-peak value Vpp of the AC voltage and the discharge current is not constant but is influenced for example by an environment of use (a change in the impedance of the charging roller), a thickness of a charge transport layer of the photosensitive drum etc. For example, even under an application of an AC voltage of a constant peak-to-peak value Vpp, the discharge amount decreases in an environment of a low temperature and a low humidity because of an increase in the impedance of the charging roller, and increases in an environment of a high temperature and a high humidity because of a decrease in the impedance of the charging roller. Also under a same environment of use, when the surface of the photosensitive drum is scraped off by the cleaning blade during the use, the discharge amount increases because the impedance becomes lower than at the initial stage of use.

In order to avoid such drawback, U.S. Pat. No. 5,420,671 proposes a method of controlling the AC component with a constant current. This method is to detect an AC current Iac from the charging roller to the photosensitive drum and to control such current at a constant level, and can maintain the discharge current substantially constant since the peak-to-peak value Vpp of the AC voltage changes flexibly in response to changes in the impedances of the charging roller and the photosensitive drum. This method is very effective in securing a satisfactory charging property and preventing an excessive discharge to the photosensitive drum.

This method requires, however, in order to obtain a stable bias voltage, to separate power supplies for the AC and DC components to be superposed, thus necessitating two voltage-elevating transformers. Within a power supply circuit, a voltage-elevating transformer is a component relatively large and relatively costly. For this reason, particularly in a compact and low-cost image forming apparatus, it has been desired to realize a stable charging bias voltage utilizing single voltage-elevating means, not dependent on an environment of use or of a thickness of the photosensitive drum, thereby providing the photosensitive with a stable discharge current.

Therefore, it is proposed, as described in U.S. Patent Application Publication No. 2003/0219268 A1, to provide a stable discharge current by a charging bias supply circuit involving single voltage-elevating means, not dependent on the environment of use. Such a, configuration will be explained in the following.

FIG. 10 is a schematic view of a charging bias supply circuit. It is based on a constant voltage control having plural AC oscillation outputs (Vpp-1, Vpp-2, . . . , Vpp-n; wherein peak-to-peak voltages have a following relation Vpp-1>Vpp-2>. . . >Vpp-n>. . . ), and utilizes only one voltage-elevating transformer for generating an AC component, and a DC is generated by a peak charging of a capacitor C10 by such voltage-elevating transformer.

An engine controller applies, from such AC oscillation outputs, the AC voltages with plural peak-to-peak voltage Vpp, and selects, as a peak-to-peak voltage of the charging AC voltage at the image formation, such a minimum Vpp that provides an AC current Iac in the photosensitive drum 10 equal to or larger than a peak-to-peak voltage selection control threshold current Iac-0 required for a charging AC voltage not inducing a charging failure.

Such charging bias voltage control allows a substantially constant current behavior to be obtained, as in a constant current control, independent from a change in the impedance in the charging roller, the photosensitive drum etc.

Such a, charging voltage control method will be called a peak-to-peak voltage selection control.

(4) Elimination of Foreign Substance on Photosensitive Drum

As explained in the foregoing, the surface of the photosensitive drum is maintained, even after repeated use, in a refreshed state equivalent to an initial state by polishing with a cleaning blade, and can enter a next image formation (charging step) without a contamination for example by a transfer residual toner.

A foreign substance such as the transfer residual toner is usually scraped off in a post-rotation step after an image formation. However, if a deposited foreign substance is in a state not easily separable from the surface of the photosensitive drum, a polishing in the post-rotation step and an initial rotation step in a next job may be insufficient for removing the foreign substance. A printing process executed with an uneliminated foreign substance may result in an image defect resulting from such a foreign substance. A following phenomenon is an example of such situation.

Referring to FIG. 11, after an end of an image forming process, a foreign substance 19 such as a transfer residual toner or a power scraped off from the photosensitive drum is positioned between the cleaning blade 17 and the photosensitive drum 10, and is pressed to the photosensitive drum 10 by the pressure of the cleaning blade 17, thus becoming not easily separable. A position X on the photosensitive drum where the foreign substance is deposited becomes different in a friction coefficient, in comparison with other positions (free from the foreign substance) on the photosensitive drum. When a next image forming process is initiated in this state and the position X reaches the cleaning blade 17 after one turn, the rotating speed of the photosensitive drum 10 becomes different only in the position X since it is different in the friction coefficient in comparison with other points. Therefore an exposure blur is generated in an exposure position Y, leading to a white streak image uniform in the longitudinal direction, as shown in FIG. 12. Then, when this position again reaches the position of the cleaning blade, a same phenomenon is repeated whereby white streak images are generated at a period R corresponding to a peripheral length of the photosensitive drum.

Since the deposited foreign substance 19 is scraped off little-by-little by the cleaning blade 17, the white streak image is most conspicuous in a first print where the amount of the foreign substance is largest, then, in a continuous use, becomes progressively less conspicuous in a second print, a third print and so forth since the foreign substance is gradually scraped off, and eventually vanishes completely as the foreign substance is eventually removed completely.

Therefore, this phenomenon can be resolved by extending a rotation time of the photosensitive drum prior to the image formation. An extension of the rotation time of the photosensitive drum before the image formation increases the chance that the position with a deposited foreign substance passes under the cleaning blade, thereby completely eliminating the foreign substance eventually.

However, in case of executing a peak-to-peak voltage selection control for the charging AC voltage and extending the photosensitive drum rotation time for completely eliminating the foreign substance from the photosensitive drum, there is required a longer time before the image formation and the time required for the entire printing process results in a significant elongation, which is undesirable from the standpoint of usability.

The present invention is to solve the aforementioned drawbacks.

SUMMARY OF THE INVENTION

An object of the present invention is to prevent generation of an image defect resulting from a charging failure.

An object of the present invention is to supply a stable discharge current at a charging operation, irrespective of an environment for use.

An object of the present invention is to completely eliminate a foreign substance, thereby constantly providing a satisfactory image.

An object of the present invention is to prevent a reduction in the service life of an image bearing member.

An object of the present invention is to supply a stable discharge current at a charging operation, irrespective of an environment for use, and to shorten the time of an entire printing process while completely eliminating a foreign substance, thereby constantly providing a satisfactory image.

BRIEF DESCRIPTION OF THE DRAWINGS

FIG. 19 is a sequence chart of the embodiment 2 showing results of the service life of the photosensitive drum in the embodiment 4.

DETAILED DESCRIPTION OF THE PREFERRED EMBODIMENTS

Embodiment 1

(1) Image Forming Process

Figure 3:
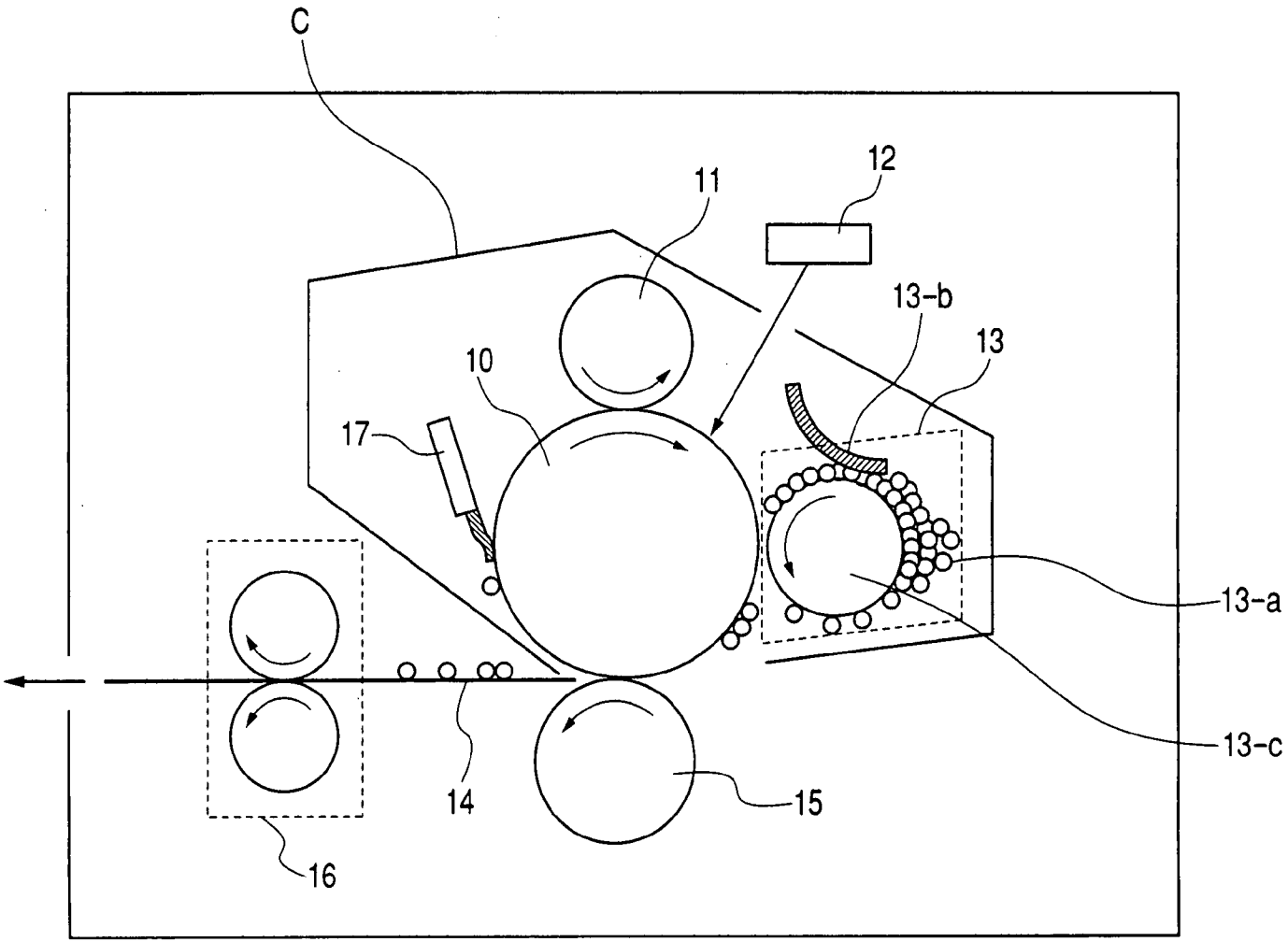
FIG. 3 is a view showing an image forming apparatus of the embodiment 1.

At first, an image forming apparatus employed in the present embodiment will be outlined. It is provided, as shown in FIG. 3, with a photosensitive drum 10 constituting a latent image bearing member, a charging roller 11 constituting charging means which uniformly charges the photosensitive drum 10, an exposure apparatus 12 for applying an imagewise exposure to the uniformly charged photosensitive drum thereby forming an electrostatic latent image, a developing apparatus 13 for developing the electrostatic latent image with a toner 13-*a* constituting a developer thereby obtaining a visible toner image, a transfer apparatus 15 for transferring the developed toner image onto a transfer material 14 constituting a transfer medium, a fixing apparatus 16 for fixing the toner image transferred onto the transfer material 14, and a cleaning apparatus 17 for scraping off a toner remaining on the photosensitive drum 10.

The cylindrical photosensitive drum 10 constituting the latent image bearing member is a negatively chargeable organic photosensitive member, and is rotated in a direction indicated by an arrow by an unillustrated motor in a main body of the image forming apparatus.

The charging roller 11 constituting the charging means is pressed toward a center of the photosensitive drum 10, and is rotated by the rotation thereof. The charging roller 11 is given a charging bias voltage from an unillustrated charging bias supply circuit, to be explained later. The charging bias voltage employs a method of superposing a DC voltage Vdc corresponding to a desired potential Vd on the drum with an AC voltage having a peak-to-peak voltage (Vpp) equal to or higher than a discharge starting voltage. Such a charging method intends, by superposing a DC voltage and an AC voltage, to resolve local potential unevenness on the photosensitive drum, and to uniformly charge the photosensitive drum to a potential Vd equal to the applied DC voltage Vdc.

The exposure apparatus 12 is to form an electrostatic latent image on the uniformly charged photosensitive drum 10, and is constituted, in the present embodiment, of a semiconductor laser scanner. The exposure apparatus applies an imagewise exposure to the photosensitive drum, corresponding to an image signal transmitted from an unillustrated host apparatus in the image forming apparatus. On the surface of the photosensitive drum, an exposed part assumes a lower absolute value of the potential in comparison with the absolute value of the charged potential, whereby an electrostatic latent image corresponding to the image information is formed in succession.

The developing apparatus 13 develops the electrostatic latent image on the photosensitive drum 10 with the toner 13-*a* constituting the developer, thereby rendering the electrostatic latent image visible (reversal development), and employs a jumping development in the present embodiment. In this method, a developing bias voltage formed by superposing an AC voltage and a DC voltage and supplied from an unillustrated developing bias source is applied to a developing sleeve, whereby the toner 13-*a*, frictionally charged negatively in a contact portion of a developer thickness regulating member 13-*b* and the developing sleeve 13-*c*, executes a reversal development of the electrostatic latent image on the photosensitive drum.

The transfer roller 15 constituting the transfer means transfers the toner image, developed on the photosensitive drum 10, onto a transfer material 14 such as paper, and is pressed toward the center of the photosensitive drum 10 by unillustrated biasing means such as a pressing spring. When a transfer step is initiated by a conveying of the transfer material 14, a positive DC transfer bias voltage is applied from an unillustrated transfer bias source to the transfer roller 15 whereby the negatively charged toner on the photosensitive drum 10 is transferred onto the transfer material 14.

The transfer bias is of a polarity opposite to the charging polarity of the toner. Namely, in case the toner is negatively charged, a positive transfer bias is employed, and, in case the toner is positively charged, a negative transfer bias is employed.

In the present embodiment, since the toner is charged negatively, there is employed a positive transfer bias.

The fixing means 16 fixes the toner image, transferred onto the transfer material 14, into a permanent image for example with heat and pressure. The permanent image after fixation is discharged to the exterior of the main body of the image forming apparatus.

The cleaning blade 17 constituting the cleaning apparatus recovers a transfer residual toner which has not been transferred completely at the transfer step from the photosensitive drum 10 to the transfer material 14, and is maintained in contact with the photosensitive drum 10 under a constant pressure and recovers the transfer residual toner thereby cleaning the surface of the photosensitive drum. After the cleaning step, the surface of the photosensitive drum enters again the charging step.

The image forming apparatus executes image formation by repeating the steps of charging, exposure, development, transfer, fixation and cleaning, utilizing the aforementioned means.

A process cartridge C includes the photosensitive drum 10, the charging roller 11, the developing apparatus 13 and the cleaning apparatus 17, and is detachably mounted on the main body of the image forming apparatus. The mounting and the detachment of the process cartridge C are executed by opening a door (not shown) provided in the main body of the image forming apparatus.

(2) Photosensitive Drum

Figure 13:
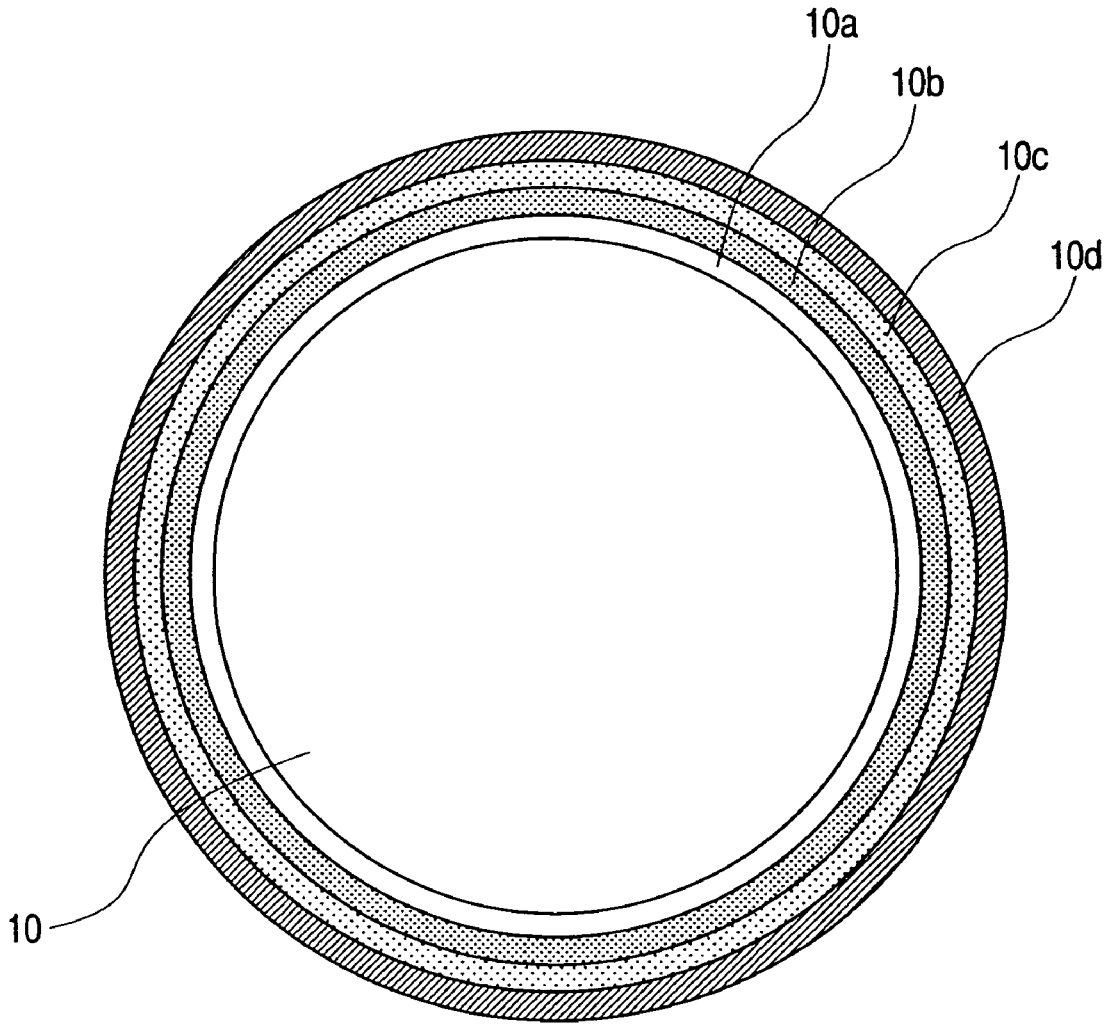
FIG. 13 is a view showing a layer structure of a photosensitive drum.

Referring to FIG. 13, the photosensitive drum 10 constituting the latent image bearing member is formed by providing, on a substrate 10*a* of a hollow aluminum cylinder of a diameter of 20 to 50 mm, an undercoat layer 10*b*, a charge generation layer 10*c* and a charge transport layer 10*d* in succession.

The undercoat layer 10*b* is provided for the purposes of improving adhesion of the charge generation layer, improving a coating property, protecting the substrate, covering a defect on the substrate, improving a charge injecting property from the substrate and protecting the photosensitive layer from electrical destruction, and has a thickness of about 0.2 to 2.0 μm.

The charge generation layer 10*c* is formed by sufficiently dispersing a charge generating pigment with a binder resin of an amount of 0.5 to 4 times and a solvent, and coating and drying the dispersion.

The charge transport layer 10*d* is formed by dissolving a charge transporting substance and polycarbonate resin or the like in a solvent and coating the solution on the charge generation layer. In general, the strength of a resin decreases with a decrease in the molecular weight, and, in case of polycarbonate resin, the strength becomes insufficient for an average molecular weight $M<5000$, so that the polycarbonate resin ordinarily employed has an average molecular weight $M \geqq 5000$.

(3) Operation Sequence of Printer

Figure 4:
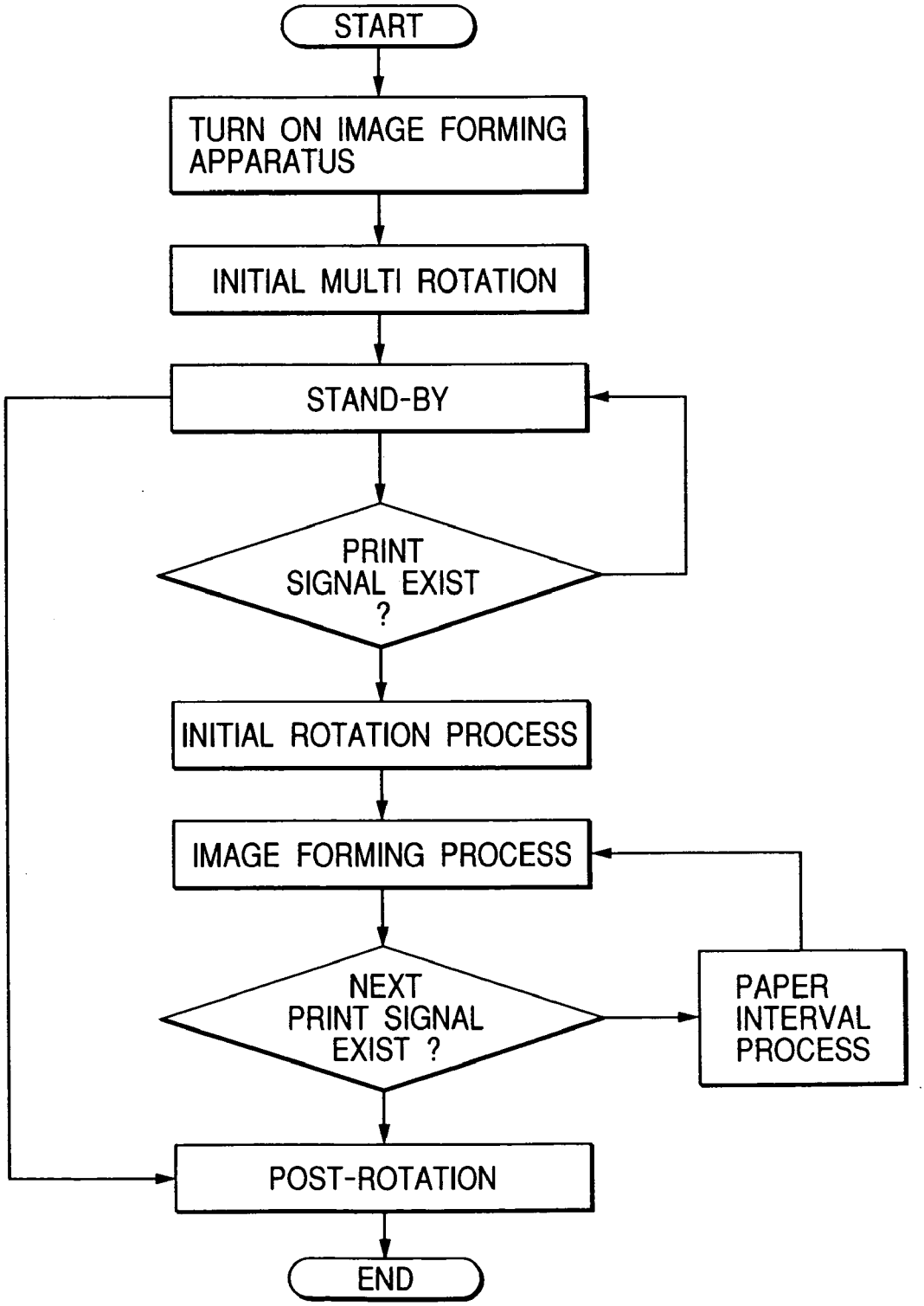
FIG. 4 is a flowchart showing an operation sequence of the image forming apparatus of the embodiment 1.

In the following, an operation sequence of the printer of the present embodiment will be explained with reference to FIG. 4.

(1) Initial Multi-rotation Step

When a power supply is turned on in the main body of the image forming apparatus, a main motor is activated to initiate an initial rotation, thereby initializing the image forming apparatus (such step being hereinafter called initial multi-rotation).

The initial multi-rotation is executed when the power supply is turned on, and, in case a print signal is supplied to the image forming apparatus in a stand-by state after a printing process, the operation is started from an initial rotation step to be explained next.

(2) Initial Rotation Step

When a print signal is supplied from output means such as an unillustrated host computer to the image forming apparatus, the unillustrated main motor drives the main body of the image forming apparatus thereby entering an initial rotation step. This step executes preparatory operations for printing in various process devices, principally including a preliminary charging of the photosensitive drum, a start-up of the laser scanner, a determination of a transfer bias, and a temperature regulation of the fixing apparatus.

(3) Print Step and Inter-sheet Step

In a printing step, there are executed steps of a charging, an imagewise exposure and a development in an area constituting an image forming area, and a toner image formed on the drum is transferred onto a transfer material such as paper. After the printing step, in case a next print signal is present, there is entered an intersheet step until a next transfer material arrives, thereby awaiting a next printing operation.

(4) Post-rotation Step

In case of absence of a next print signal after the end of the printing step, the image forming apparatus enters a post-rotation step, which executes a charge elimination of the surface of the photosensitive drum, and a discharge of the toner sticking to the transfer roller onto the photosensitive drum (cleaning of the transfer roller).

When the post-rotation step is completed, the image forming apparatus enters a stand-by state again, thus waiting for a next print signal.

(4) Peak-to-Peak Voltage Selection Control for AC Charging Voltage

Now there will be explained a peak-to-peak voltage selection control for AC charging voltage employed in the present embodiment. The peak-to-peak voltage selection control is a control method of suitably selecting a peak-to-peak voltage of the charging AC voltage (charging peak-to-peak voltage) to be applied to an image forming area for forming a toner image to be transferred to the transfer medium, thereby providing a stable discharge current regardless of the environment of use, thus achieving a uniform charging and preventing generation of an image defect resulting from a charging failure.

Figure 5:
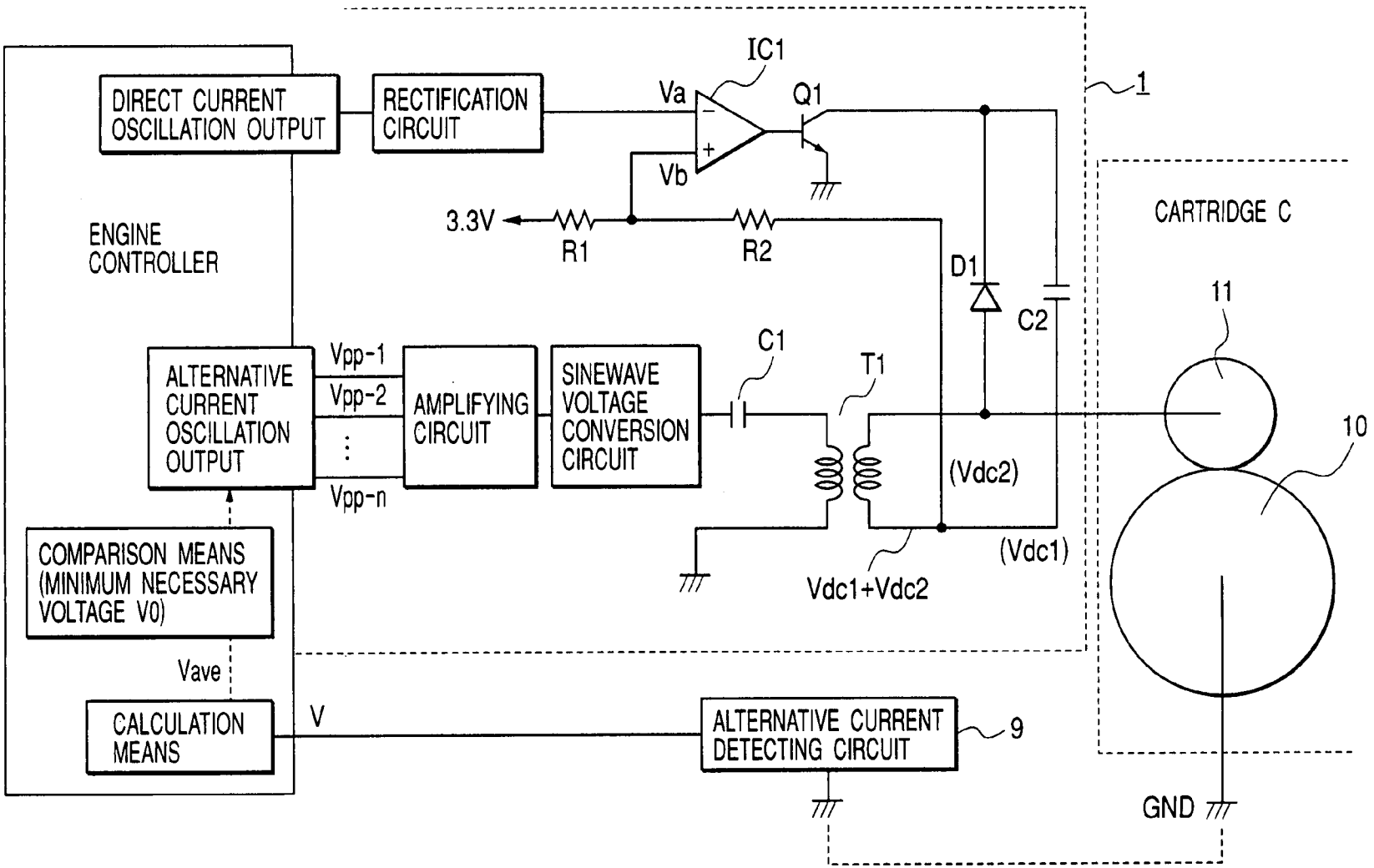
FIG. 5 is a diagram showing a charging bias supply circuit of the embodiment 1.

4-1) Process From an AC Current Detection to a Peak-to-Peak Voltage Selection for Charging AC Voltage A method for selecting a charging peak-to-peak voltage in the present embodiment will be explained with reference to FIG. 5.

A charging bias voltage source 1, which is a power supply circuit, can supply the charging roller 11 constituting the charging means with an AC and DC superposed voltage by means of single voltage-elevating means T1. The charging bias voltage source 1 constituting the power supply can stepwise apply two or more different peak-to-peak voltages.

The charging bias voltage source 1 applies a first AC voltage for the peak-to-peak voltage selection control (hereinafter called a peak-to-peak voltage selecting bias). The charging bias voltage source applies a charging bias voltage to the charging roller 11, utilizing the voltage-elevating means TI etc., and selecting the peak-to-peak voltage selecting bias as Vpp-1, Vpp-2, . . . , Vpp-n, Vpp-(n+1), . . . (wherein the peak-to-peak voltages have a magnitude relationship of Vpp-1>Vpp-2>. . . >Vpp-n>Vpp-(n+1)>. . . ). In response an AC current Jac flows to a ground terminal GND through the charging roller 11 and the photosensitive drum 10. An AC current detection circuit 9, constituting AC current detection means, executes a sampling, in such AC current, of an AC current having a frequency, which is the same as a charging frequency by an unillustrated filter circuit formed by a resistor and a capacitor, and converts it into a detection voltage V which is supplied to an engine controller. Thus the detection voltage V is entered, as information based on the AC current amount, into the engine controller. The detection voltage V, sampled at a predetermined period, is averaged in the engine controller.

The averaged detection voltage Vave is compared by comparison means in the engine controller, with a peak-to-peak voltage selection control threshold value V0 for the charging AC voltage, stored in advance. The peak-to-peak voltage selection control threshold value V0 for the charging AC voltage is so selected as to correspond to a detection voltage detected by the AC current detection circuit and averaged when a minimum necessary current (peak-to-peak voltage selection control threshold current for charging AC voltage) Iac-0 capable of uniform charging without unevenness flows from the charging roller through the photosensitive drum to the GND.

Since the value Iac-0 varies depending on the process speed and the charging frequency of the apparatus, and the material constituting the charging roller 11 and the photosensitive drum 10, the peak-to-peak voltage selection control threshold value V0 for the charging AC voltage is preferably selected for each case.

4-2) Peak-to-Peak Voltage Selection Control for Charging AC Voltage in Initial Rotation at the Start of Power Supply (Initial Multi-rotation)

When a power supply is turned on in the main body of the image forming apparatus, a main motor is activated to initiate an initial rotation (such step being hereinafter called initial multi-rotation). In this state, the engine controller of the main body of the image forming apparatus applies all the applicable AC voltages with different peak-to-peak voltages or a part thereof to the charging roller, and executes such a control as to use, as the AC voltage for image formation, an AC voltage having a minimum peak-to-peak value for which a detection voltage obtained from an AC current flowing from the charging roller to the photosensitive drum is equal to or larger than the peak-to-peak voltage selection control threshold value V0. For example, AC voltages are applied in an increasing order of the peak-to-peak voltage, such as Vpp-(n+2), Vpp-(n+1), Vpp-n, and Vpp-(−1) (magnitude of the peak-to-peak values of the AC voltages being Vpp-(n+2) <Vpp-(+1)<Vpp-n<Vpp-(n−1)). Since the magnitude of Vpp corresponds to that of the corresponding current Iac and that of the voltage detected by the AC current detection circuit, the respectively detected voltages Vn+2, Vn+1, Vn and Vn−1 assume a magnitude relationship of Vn+2<Vn+1<Vn<Vn−1. In case a relation Vn+2<Vn+1<V0<Vn<Vn−1 is obtained in connection with the peak-to-peak voltage selection control threshold value V0 for the charging AC voltage, the peak-to-peak voltage for the charging AC voltage at image formation is selected at Vpp-n. Stated differently, Vn+2 or Vn+1 does not provide a detection voltage equal to or larger than the peak-to-peak voltage selection control threshold value V0 for the charging AC voltage, but Vn or Vn−1 provides a detection voltage equal to or larger than the peak-to-peak voltage selection control threshold value V0 for the charging AC voltage. Vn is selected because it is the AC voltage having the minimum peak-to-peak value among Vn and Vn−1. The detection voltage may also be obtained by averaging detection voltages of plural times. In this manner, in the initial multi-rotation step, there is provided a first peak-to-peak voltage selecting step for selecting a peak-to-peak voltage capable of reaching a minimum necessary current enabling a uniform charging. Such step allows a correction to an optimum peak-to-peak voltage at the start of power supply. In the foregoing explanation, for the ease of understanding, the detection voltage is determined up to Vn−1 beyond the peak-to-peak voltage selection control threshold value V0 for the charging AC voltage, but the first peak-to-peak voltage selecting step may naturally be terminated as soon as the detection voltage Vn, equal to or larger than the peak-to-peak voltage selection control threshold value V0 for the charging AC voltage is obtained.

In this operation, each peak-to-peak voltage selecting bias is preferably applied for a period at least equal to a turn of the latent image bearing member. The photosensitive drum may show an unevenness in the film thickness along the periphery for example due to an uneven scraping resulting from an eccentric rotation, and the resulting AC current Iac may show a fluctuation at the rotating period of the photosensitive drum, so that it is preferable to continue the application of the bias voltage for at least a turn of the photosensitive drum in order to achieve a precise current detection. However, the application time of the bias voltage should not be made excessively long, since a longer application time extends the time of the entire process. In the present embodiment, the first peak-to-peak voltage selecting step is executed at each start of the power supply, but such example is not restrictive. For example, the first peak-to-peak voltage selecting step may be executed at a time other than the start of the power supply.

4-3) Peak-to-Peak Voltage Selection Control for Charging AC Voltage in Initial Rotation The peak-to-peak voltage selection control for the charging AC voltage is preferably executed also in the initial rotation step prior to the image formation. This is because, in case the peak-to-peak voltage selection control for the charging AC voltage is executed only in the initial multi-rotation step at the start of power supply, an appropriate peak-to-peak voltage selection is not at all executed in an image forming apparatus not provided with the initial multi-rotation step (for example an image forming apparatus of which power supply is always turned on). However, the peak-to-peak voltage selecting step in the initial multi-rotation step, explained in the foregoing 4-2 voltage selection control). involves successive applications of the peak-to-peak voltage selecting biases and requires a time.

As the film thickness of the photosensitive drum decreases with the progress of a durability run, a resulting current increases even under a voltage application same as that when the film thickness is larger. In consideration of a positive relationship between the current and the voltage, the required peak-to-peak voltage may be made lower than the previous one with the progress of the durability run.

Therefore, in the peak-to-peak voltage selection control after the initial multi-rotation step, it is possible, by selecting a peak-to-peak voltage smaller than the peak-to-peak voltage selected in the preceding image formation as the peak-to-peak voltage selecting bias, to achieve a reduction in the control time in comparison with the peak-to-peak voltage selecting step in the initial multi-rotation step, as explained in the foregoing 4-2 voltage selection control). Thus, in the initial rotation step, there is provided a second peak-to-peak voltage selecting step for selecting a peak-to-peak voltage before reaching the minimum necessary current required for charging.

Figure 6:
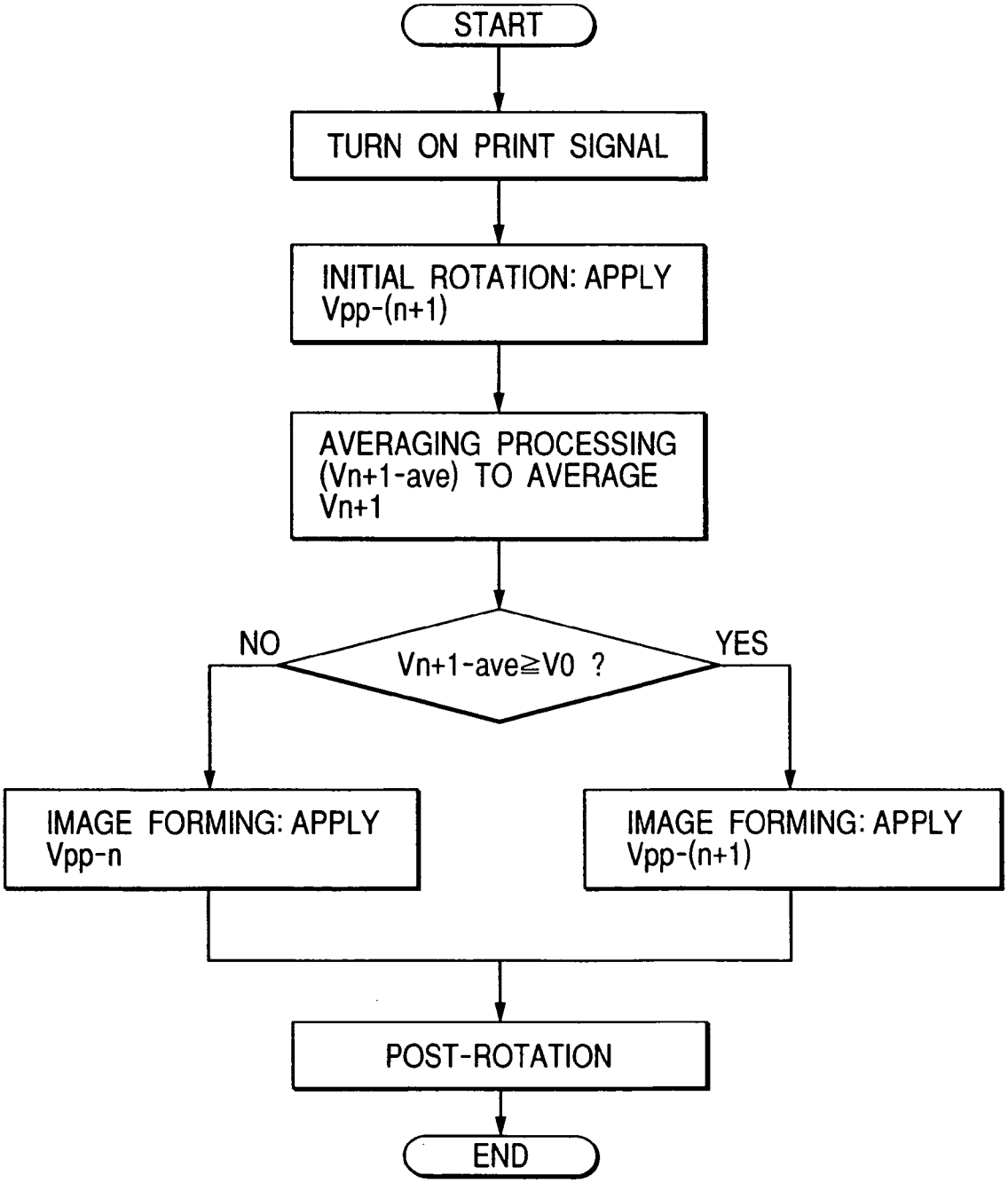
FIG. 6 is a flow chart showing a charging bias selecting method in an initial rotation in an embodiment 3.

In the initial rotation step, the selection of the peak-to-peak charging voltage is executed in a following procedure. Referring to FIG. 6, taking the peak-to-peak voltage for the image formation, determined in the peak-to-peak voltage selecting method for the charging AC voltage in the initial multi-rotation step, as explained in the foregoing 4-2 voltage selection control), as Vpp-n, the initial rotation step applies only a voltage Vpp-(n+1) which is lower than Vpp-n by one step.

It is possible to stepwise lower the peak-to-peak voltage of the appropriate AC voltage to be used for image formation, in consideration of the influence of scraping of the surface of the photosensitive drum in use. It is therefore possible to execute a voltage switching at an appropriate timing by comparing a detection voltage Vn+1, corresponding to the application of Vpp-(n+1), which is lower by one step than the currently employed charging peak-to-peak voltage Vpp-n, with the peak-to-peak voltage selection control threshold value V0 for the charging AC voltage.

The detection voltage Vn+1 is averaged by the operation means in the engine controller to provide an averaged detection voltage Vn+1-ave, which is compared by the comparison means with the peak-to-peak voltage selection control threshold value V0 for the charging AC voltage. In case Vn+1-ave<V0, Vpp-n is selected as the peak-to-peak voltage of the charging AC voltage for image formation, but, in case Vn+1-ave>V0, the image formation is executed by switching the peak-to-peak voltage of the charging AC voltage to Vpp-(n+1).

This method does not require the application of an unnecessary charging voltage and can be executed within a short time, so that the initial rotation time need not be extended.

(5) Sequence for Foreign Substance Elimination on Photosensitive Drum

When the main motor is stopped after the image formation, a foreign substance such as a transfer residual toner remaining principally in a contact position of the cleaning blade on the photosensitive drum causes a white streak image, uniform in the longitudinal direction, in a next image formation. In order to avoid such a phenomenon, it is possible to extend the initial rotation time as in the prior technology, but the present embodiment applies, as a bias for eliminating the foreign substance, a second AC voltage (hereinafter called a foreign substance eliminating bias) having a peak-to-peak voltage larger than the peak-to-peak voltage of the peak-to-peak voltage selecting bias. The application of such a foreign substance eliminating bias increases the discharge current to the photosensitive drum, thereby facilitating a cleavage of a chain connecting molecules on the surface of the photosensitive drum. Consequently a resin constituting the surface of the photosensitive drum is modified toward a lower molecular weight, and becomes more easily scrapable with the cleaning blade, so that the foreign substance deposited on the drum surface is also eliminated. As explained in the foregoing, the AC voltage for charging the image forming area is selected at a minimum necessary peak-to-peak voltage by the peak-to-peak voltage selection control. Also, for the aforementioned reason, the peak-to-peak voltage of the peak-to-peak voltage selecting bias is smaller than the peak-to-peak voltage of the AC voltage for charging the image forming area. Consequently, the peak-to-peak voltage selecting bias is not effective for eliminating the foreign substance. Therefore, the bias for foreign substance elimination is applied only in a partial time, such as the initial rotation, thereby eliminating the foreign substance prior to the image formation. The foreign substance eliminating bias is applied for at least a turn of the photosensitive drum, preferably for three turns of more. Also the foreign substance eliminating bias is preferably a peak-to-peak voltage of a maximum AC voltage applicable to the charging roller by the charging bias supply source.

Such a foreign substance eliminating bias is preferably applied in a non-image forming area. More preferably it is applied in an initial rotation step immediately before the image formation. As the foreign substance deposited and becoming not easily removable at the end of a preceding job is effectively eliminated by the foreign substance eliminating bias before the start of the next image formation, so that the surface of the photosensitive drum is refreshed immediately before the image formation and can always provide a satisfactory image.

Also the peak-to-peak voltage of the foreign substance eliminating bias, if larger than the peak-to-peak voltage of the AC voltage for charging the image forming area, can provide an effect of facilitating the scraping of the surface of the photosensitive drum.

(6) Charging Sequence

Now let us consider an image forming apparatus characterized by the invention in that the charging AC voltage selecting bias and the foreign substance eliminating bias are both applied to the charging means at the initial rotation step.

During the application of the charging AC voltage selecting bias, there may not be obtained a current necessary for charging, so that the potential Vd on the photosensitive drum does not completely reach the desired drum potential Vd but remains unstable. On the other hand, under the application of the foreign substance eliminating bias, which is larger than the charging bias at the image formation, the potential Vd on the photosensitive drum becomes stabilized.

FIG. 2 shows a relationship between the peak-to-peak voltage selecting sequence and the potential on the photosensitive drum.

Figure 2A:
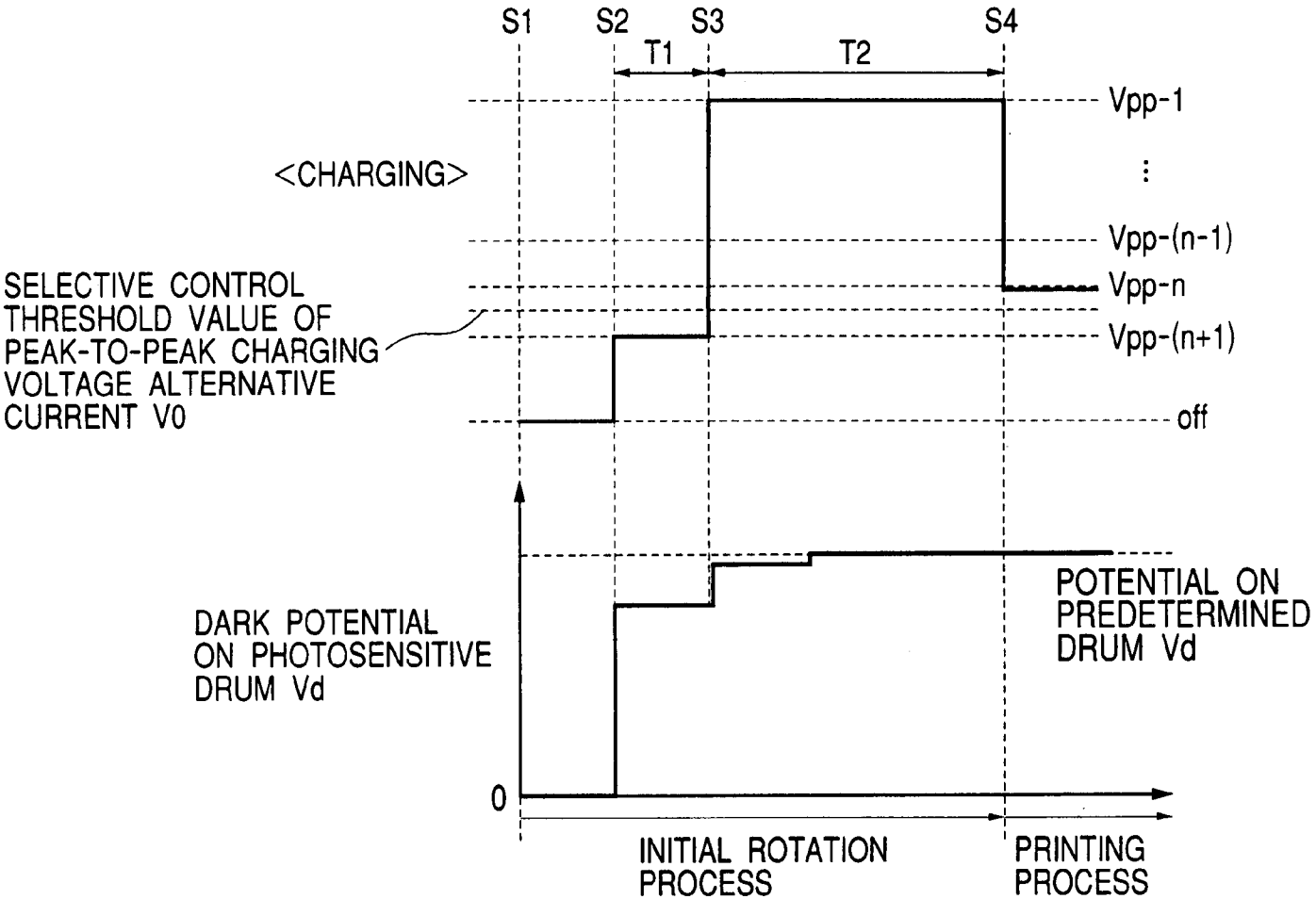
FIG. 2A is a chart showing a relation between a sequence of an embodiment 1 and a potential on a photosensitive drum.

Referring to FIG. 2A showing an embodiment of the present invention, the potential on the photosensitive drum does not reach the desired value during the peak-to-peak voltage selecting step (S2–S3), but becomes stabilized to the desired value when the foreign substance eliminating bias Vpp-1 is applied, so that the image formation can be started immediately after (S4) the end of application of the foreign substance eliminating bias Vpp-1.

Figure 2B:
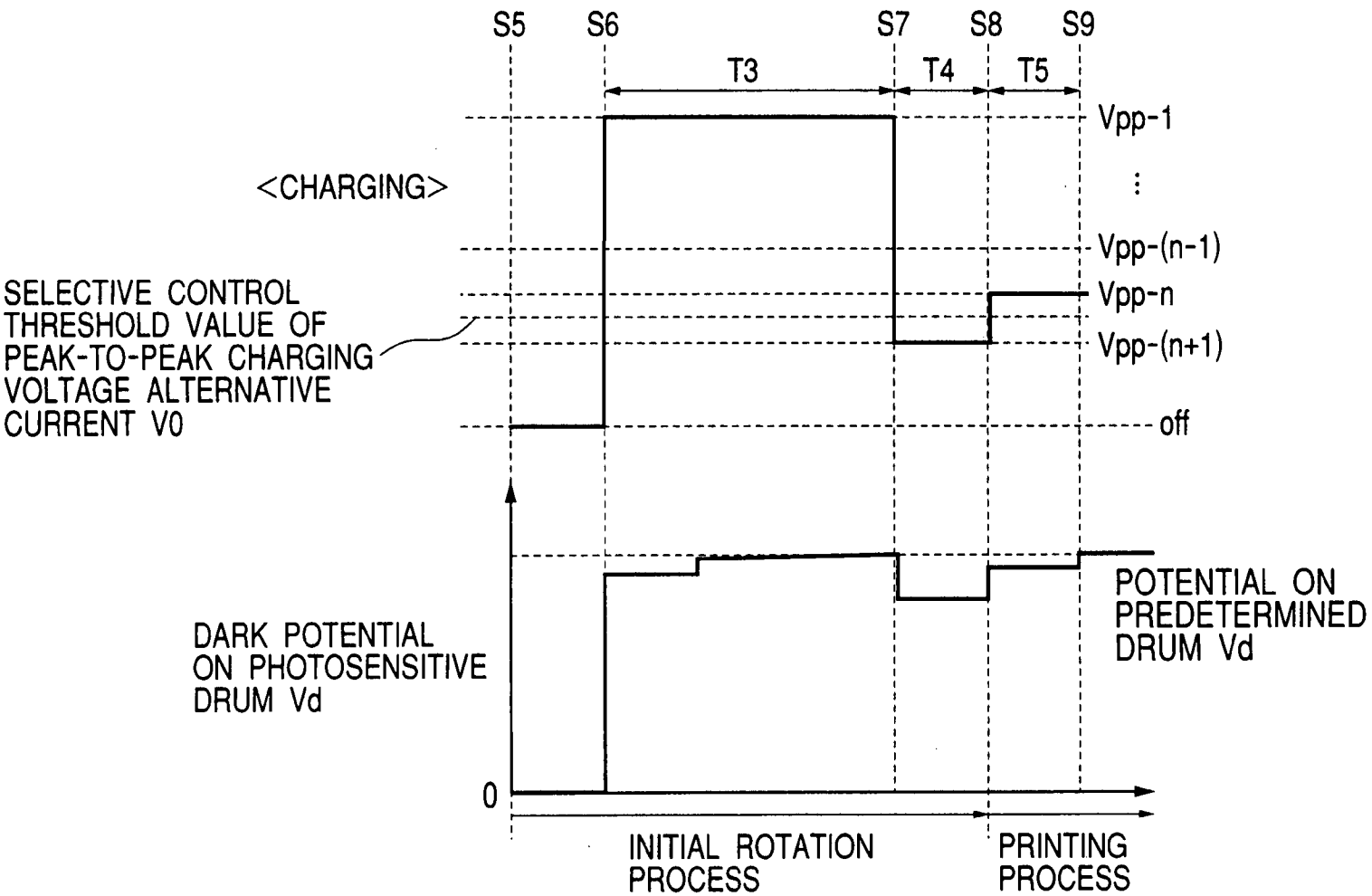
FIG. 2B is a chart showing a relation between a sequence of a comparative example 1 and a potential on a photosensitive drum.

Then, as a comparative example 1, there was considered a case of inverting the order of applications as shown in FIG. 2B, namely applying the foreign substance eliminating bias at first (S6–S7) and then executing the peak-to-peak voltage selecting step (S7–S8). In such case, the potential Vd on the photosensitive, which is stabilized during the application of the foreign substance eliminating bias (S6–S7), becomes unstable in the peak-to-peak voltage selecting step (S7–S8). In order to avoid such situation, the image formation may be started after applying a charging AC voltage for image formation during an additional turn (S8–S9) of the photosensitive drum thereby achieving a preliminary charging (S9), but such a method requires an extension of the initial rotation step by a time T5, thus requiring an additional time for image formation.

Thus, the extension of the initial rotation step as in the comparative example 1 can be dispensed with by executing, in the initial rotation step, the charging bias selecting step at first and then executing the application of the foreign substance eliminating bias, as in the example 1.

As explained in the foregoing, by applying a first AC voltage for selecting the charging peak-to-peak voltage at first and then applying a second AC voltage for foreign substance elimination, it is rendered possible to supply a stable discharge current at the charging operation irrespective of the environment of use, and to eliminate the foreign substance thereby constantly providing a satisfactory image. Also the entire printing process can be limited within a short time.

In the present embodiment, there has been explained a case of applying the foreign substance eliminating bias after the second peak-to-peak voltage selecting step, but, also in case of applying the foreign substance eliminating bias after the first peak-to-peak voltage selecting step, the aforementioned effects can be obtained by applying the foreign substance eliminating bias after the application of the first AC voltage for the charging peak-to-peak voltage selection. Even in the first peak-to-peak voltage selecting step, the application of an AC voltage incapable of providing a current necessary for the charging (for example such AC voltage as Vpp-(n+2) or Vpp-(n+1) explained in 4-2)) causes an unstable potential area on the photosensitive drum, so that the application of the foreign substance eliminating bias after the peak-to-peak voltage selecting step enables the supply of a stable discharge current and a reduction in the printing process time.

Embodiment 2

(1) Transfer Bias Control

The present embodiment relates to an image forming apparatus employing an active transfer voltage control (hereinafter called ATVC) for controlling the transfer current supplied to the transfer apparatus, constituting the transfer means. The ATVC will be explained later.

At first an explanation will be given on the transfer apparatus and the method for controlling the transfer bias voltage.

The transfer apparatus principally employs a contact transfer method in which the transfer apparatus is pressed to the latent image bearing member thereby executing a transfer to the transfer material constituting the transfer medium, and within such method, there is principally employed a roller transfer method which is superior in conveying property for the transfer material at the transfer unit. In the roller transfer method, a transfer roller is pressed to the photosensitive drum under a total pressure of 4.9 to 19.6 N (0.5 to 2.0 kg) to form a transfer nip between the photosensitive drum and the transfer roller, and, while the transfer material is nipped and conveyed in such transfer nip, a toner image on the photosensitive drum is transferred onto the transfer material under a bias voltage applied to the transfer roller.

In an image forming apparatus provided with transfer means of contact type (for example a copying machine or a laser beam printer), the transfer bias supplied to the contact transfer member is generally subjected to a constant voltage control or a constant current control.

In the constant voltage control, because the transfer roller employed as the contact transfer member shows a change of a significant order in the resistance by the environmental conditions, it is difficult to constantly apply a stable transfer bias regardless of the environment.

On the other hand, the constant current control can resolve the aforementioned drawback resulting from the change in the resistance of the transfer roller and can always secure a charge amount necessary for the transfer. However, since the image forming apparatus of the aforementioned type is usually so designed as to accept transfer materials of various sizes, in case a transfer material of a smaller size is passed, a sheet non-passing area where the photosensitive drum and the transfer member are in direct contact becomes wider and passes most of the current, whereby the transfer charge becomes deficient and leads to a transfer failure particularly in an environment of a low temperature and a low humidity.

In order to avoid such drawback, there is proposed a method ATVC for achieving an optimum current at the sheet passing.

For example, a constant current control is executed in a sheet non-passing state where a transfer material is absent in the transfer position, and a voltage in such state is held and used for executing a constant voltage control when a sheet is passed.

More specifically, a constant current is supplied to a dark portion (Vd portion) of the photosensitive drum showing a constant value to monitor a generated voltage, and such voltage is used for controlling the applied bias under certain operations such as (1) a same value, (2) multiplied by a factor, (3) added by a fixed voltage etc., thereby providing a certain effect in preventing fluctuation in the transfer property resulting from an environmental fluctuation or a difference in the size of the transfer material.

Also there is known a method of monitoring a current flowing between the photosensitive drum and the charging member under the application of different transfer voltages, and employing a transfer voltage providing an optimum current as the transfer voltage in sheet passing.

(2) Charging/Transfer Sequence in Embodiment 2

The sequence of charging and transfer in the present embodiment will be explained. During the initial rotation step, the peak-to-peak voltage selection for the charging AC voltage is executed at first and the application of the foreign substance eliminating bias is executed later as in the example 1. The present embodiment is characterized in that a positive transfer voltage for controlling the transfer voltage is applied after an area of the photosensitive drum, charged by the foreign substance eliminating bias, arrives at a contact portion with the transfer apparatus (transfer position). In the following description, portions, which are the same as those in the embodiment 1, will be omitted.

Figure 1:
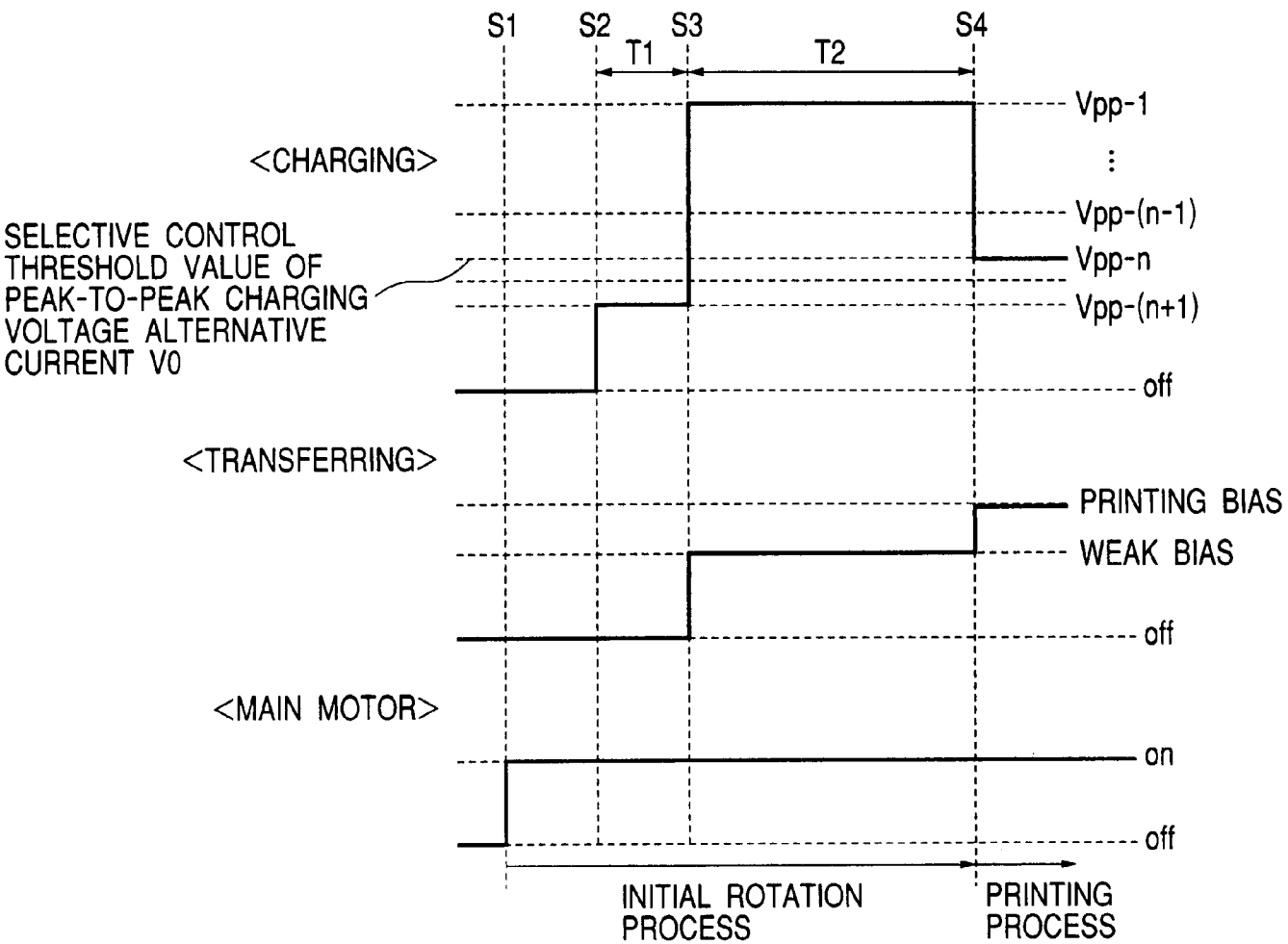
FIG. 1 is a sequence chart of an embodiment 2.

In the charging/transfer sequence during the initial rotation step as shown in FIG. 1, the method of applying the peak-to-peak voltage selecting bias and the foreign substance eliminating bias is same as that in the embodiment 1.

As explained in the embodiment 1, during the application of the peak-to-peak voltage selecting bias, a current necessary for charging cannot be obtained, so that the potential Vd on the photosensitive drum does not completely reach the desired drum potential Vd but remains unstable, but the potential Vd on the photosensitive drum becomes stabilized when the foreign substance eliminating bias is applied.

Figure 14A:
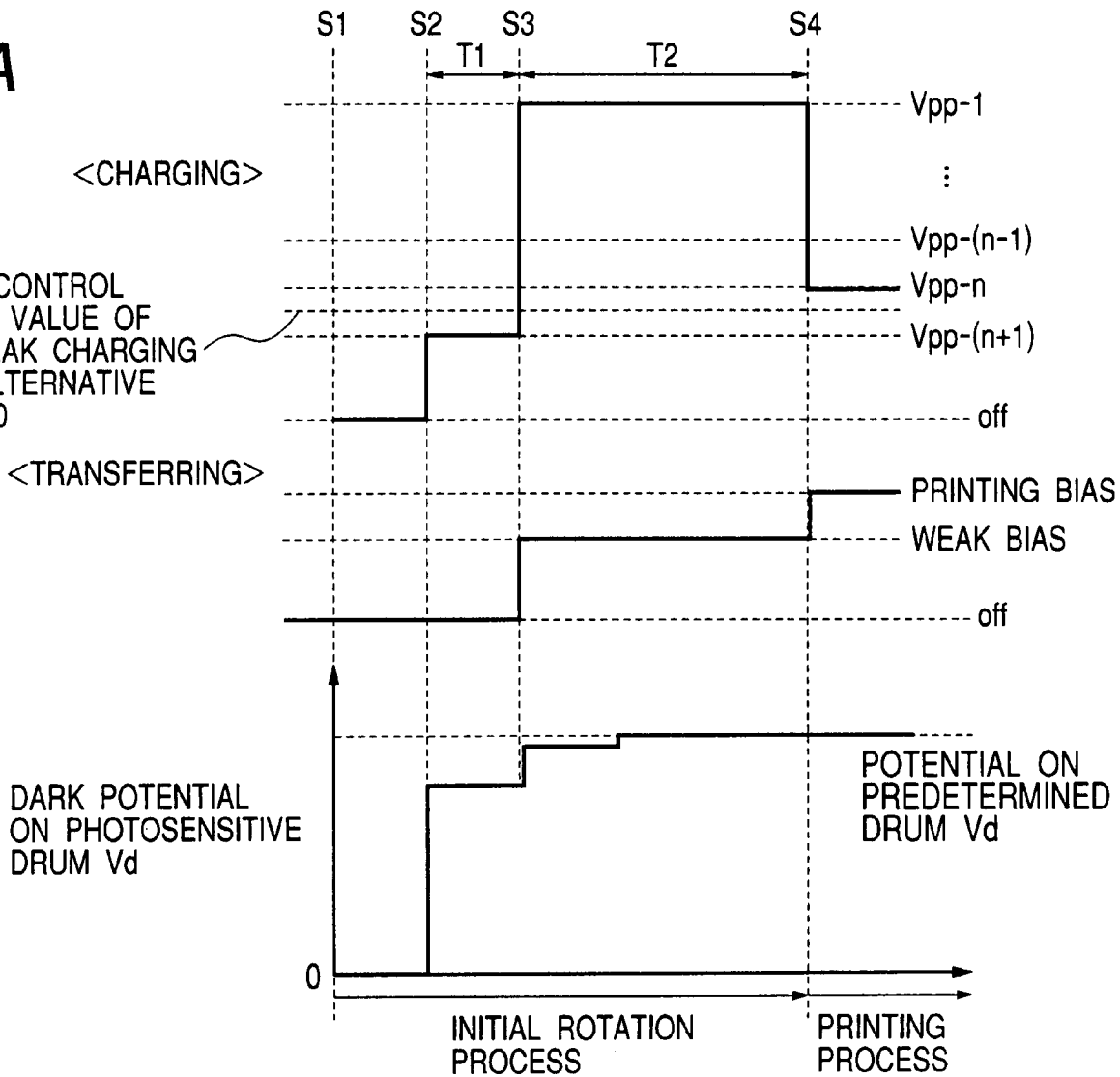
FIG. 14A is a chart showing an operation sequence of an image forming apparatus of the embodiment 2.

Referring to FIG. 14A showing the configuration of the embodiment 2, the potential on the photosensitive drum does not reach the desired value during the peak-to-peak voltage selecting step (S2–S3), but becomes stabilized to the desired value when the foreign substance eliminating bias Vpp-1 is applied, so that the image formation can be started immediately after (S4) the end of application of the foreign substance eliminating bias Vpp-1. During the peak-to-peak voltage selecting step (S2–S3) for the photosensitive drum, as the positive transfer voltage is not applied, the photosensitive drum is prevented from a situation where it is charged positively by the transfer voltage thereby generating a memory in the photosensitive layer on the surface of the photosensitive drum. Also as an application of a positive voltage for transfer voltage control is executed in an area having a stable potential Vd on the photosensitive drum, the transfer voltage control can be executed in a more stable manner. In the present embodiment, a weak transfer bias for the transfer voltage control is applied (S3–S4) in the entire area where the foreign substance eliminating bias is applied, but it may also be applied in a part of the area where the foreign substance eliminating bias is applied.

Figure 14B:
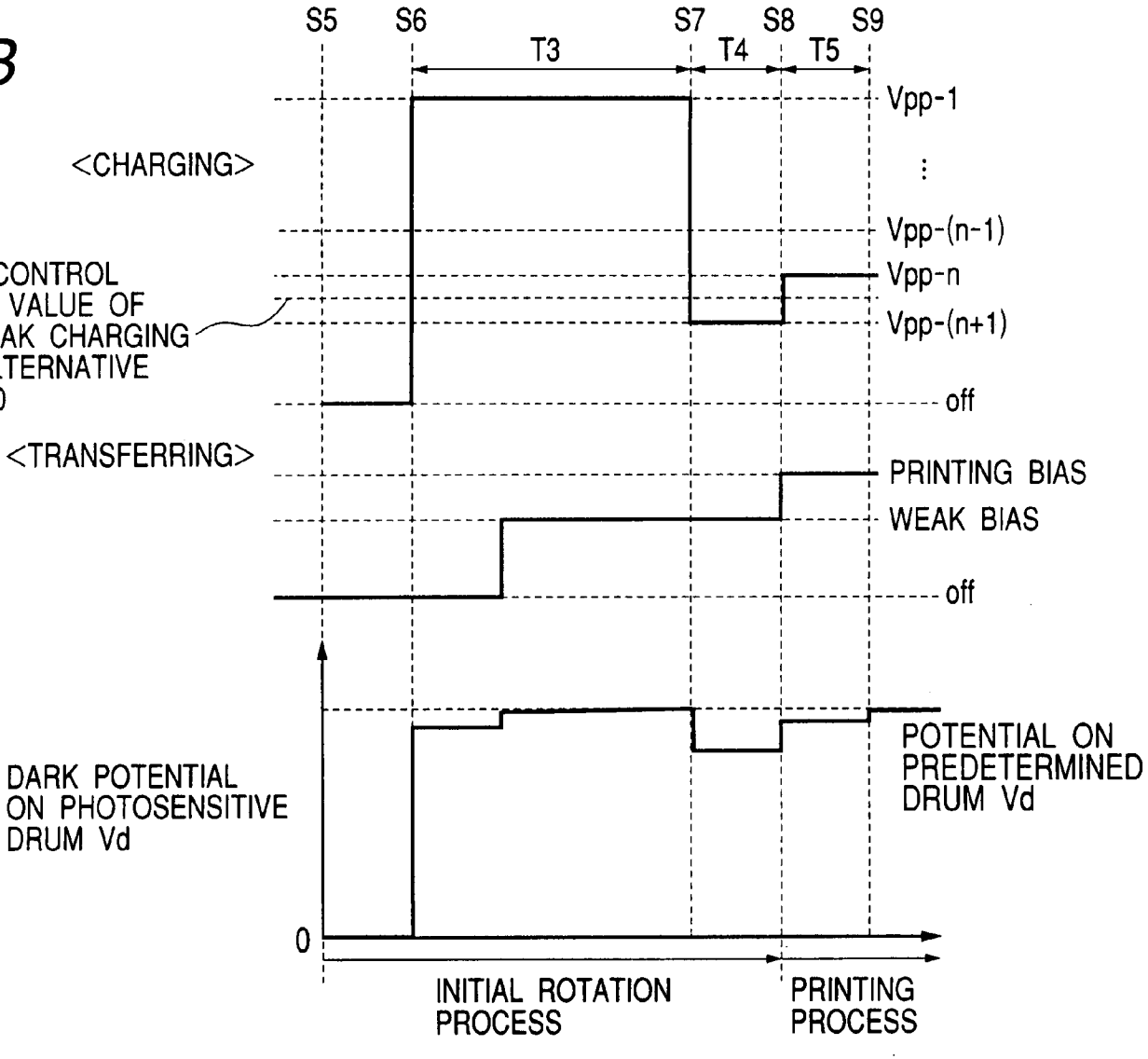
FIG. 14B is a chart showing an operation sequence of an image forming apparatus of a comparative example 2.

In a comparative example 2, a positive transfer voltage (weak bias) is applied, for the transfer control as in ATVC, during the peak-to-peak voltage selecting step (S7–S8) as shown in FIG. 14B. In this case, since the positive transfer voltage is applied in an area having an unstable potential Vd on the photosensitive drum, the photosensitive drum is positively charged under the influence of the transfer voltage. Therefore, in case an image formation is started immediately after (S8) the end of the peak-to-peak voltage selecting step, such a, positively charged area cannot assume a sufficient potential Vd during a first turn (S8–S9) of the photosensitive immediately after the start of image formation, thereby causing a defective charging in such an area (S8–S9). Also an error may be generated in the transfer voltage control since the control is executed in an unstable area. In order to avoid such situation, the transfer bias for the transfer voltage control may be applied after applying a charging bias for image formation during an additional turn (S8–S9) of the photosensitive drum thereby achieving a preliminary charging (S9), but such method requires an extension of the initial rotation step by a time T5, thus requiring an additional time for the image formation.

In the present embodiment, the positive transfer voltage for the transfer voltage control is applied when an area of the photosensitive drum, charged by the application of the foreign substance eliminating bias, is positioned in a contact position with the transfer apparatus (transfer position), thereby realizing effects of reducing the time of the initial rotation step and preventing the defective charging caused by the positive charging of the photosensitive drum.

The embodiment 2 utilizes the application of the transfer voltage for the purpose of transfer voltage control, but the present invention is also applicable in a case of applying a transfer bias, which has a polarity opposite to the normal charging polarity of the photosensitive drum and may generate a memory in the image bearing member, such as a transfer bias for eliminating the foreign substance on the transfer member. More specifically, even in case of applying the transfer bias to the transfer means in an area of the image bearing member charged by the application of the foreign substance eliminating bias (namely an area with stable potential Vd on the photosensitive drum), it is possible to avoid a memory generation in the photosensitive layer of the photosensitive drum, whereby a satisfactory charging property can be obtained in the subsequent image forming step.

Also with respect to the prevention of memory generation in the photosensitive layer of the photosensitive drum, the effects of the present invention can be obtained also when the peak-to-peak voltage selecting bias is not applied. More specifically, also in case of applying, for the purpose of foreign substance elimination, an AC voltage for a non-image forming area having a peak-to-peak voltage larger than the peak-to-peak voltage of the charging AC voltage for charging the image forming area and then applying a transfer bias for ATVC in an area of the photosensitive drum charged by such AC voltage for the non-image forming area, it is possible to avoid a memory generation in the photosensitive layer of the photosensitive drum, whereby a satisfactory charging property can be obtained in the subsequent image forming step. In the embodiment 2, since the foreign substance eliminating bias constituting the second AC voltage has a peak-to-peak voltage larger than that of the charging AC voltage, such second AC voltage also constitutes, stated differently, the AC voltage for the non-image forming area.

Embodiment 3

The present embodiment relates to an image forming apparatus having, in a same main body, a special mode in which an initial rotation time is extended than in the normal state.

In the present embodiment, the image forming process and the charging bias control method are the same as those in the embodiment 1 and therefore, will not, be explained further.

When image information is supplied from output means such as a host computer to the image forming apparatus, a main motor drives the image forming apparatus thereby entering an initial rotation step. This step executes preparatory operations for printing in various process devices, principally including a preliminary charging of the photosensitive drum, a start-up of the laser scanner, a determination of a transfer voltage, and a temperature regulation of the fixing apparatus.

The initial rotation step in a normal mode is limited to a predetermined time for executing the aforementioned regulations, but may be extended in a certain special situation.

For example, the fixing apparatus may vary the fixing temperature thereof according to the type of the transfer material, in order to satisfactorily fix the toner image regardless of the type of the transfer material. For example, in case of printing on a heavier paper thicker than an ordinary paper, it is necessary to elevate the fixing temperature by about 5 to 20° C. in comparison with the printing on an ordinary paper, and the initial rotation time is extended as a longer time is required for temperature elevation for the temperature control at a higher temperature.

Figure 7A:
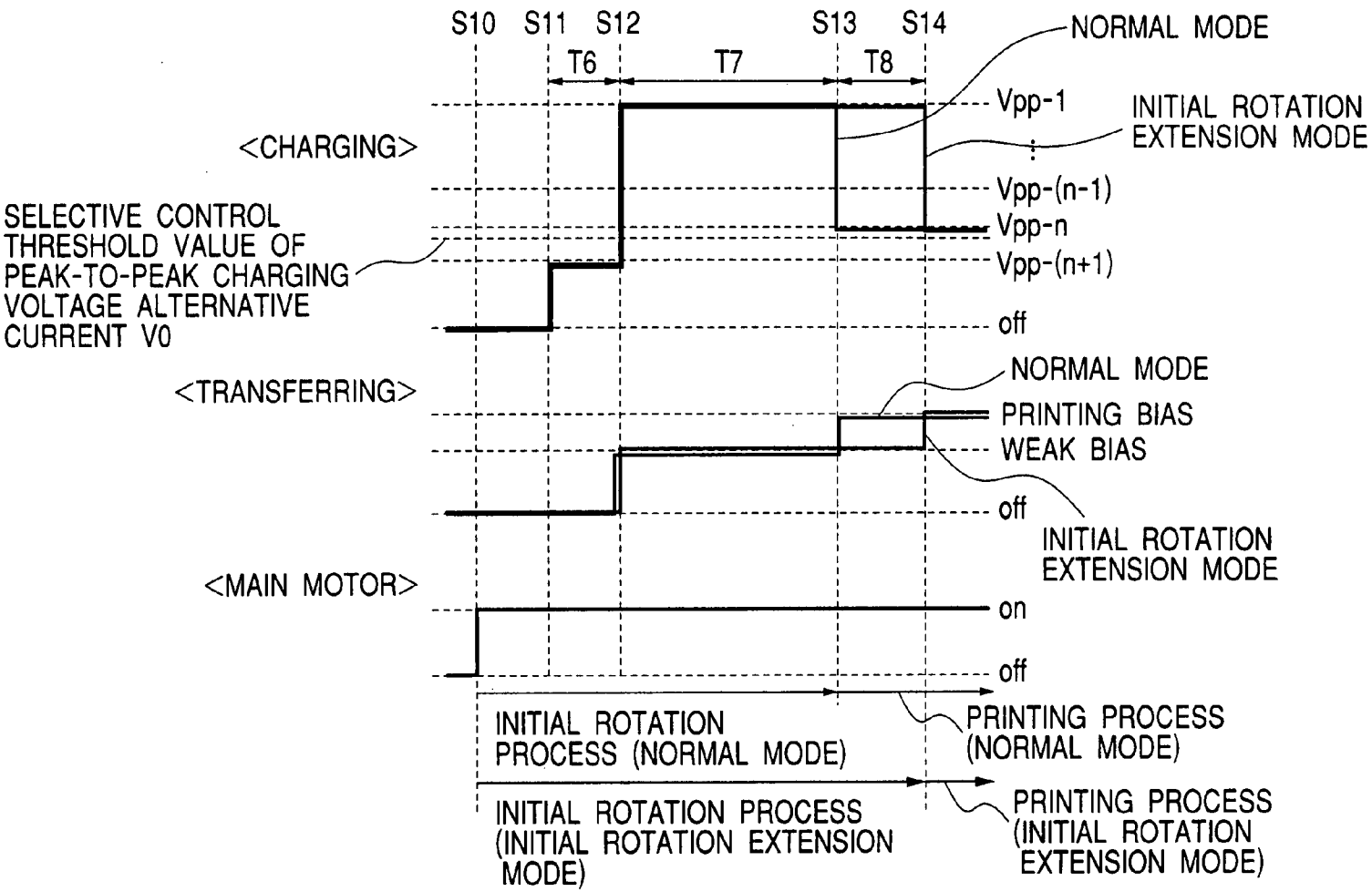
FIG. 7A is a sequence chart of the embodiment 2.
Figure 7B:
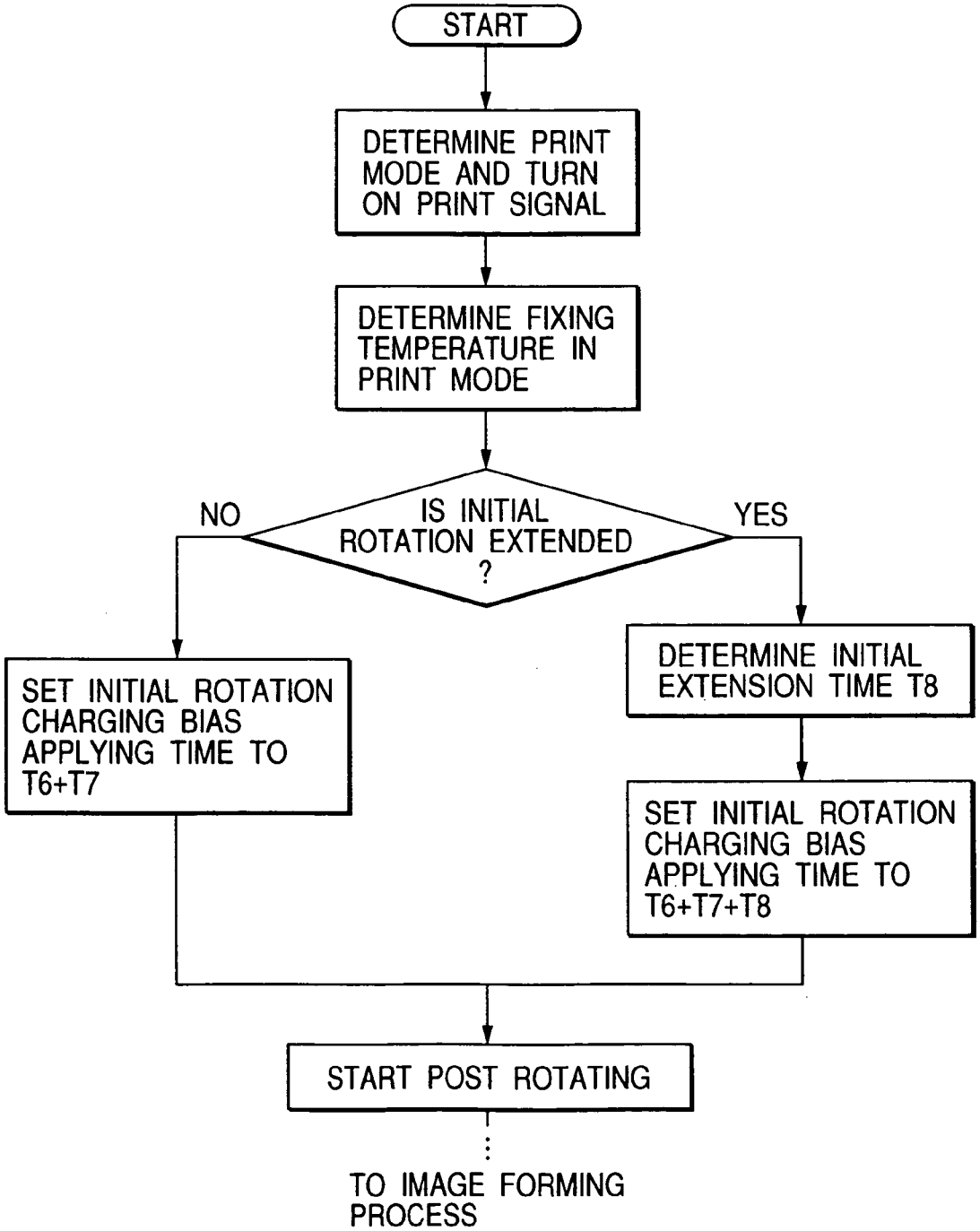
FIG. 7B is a flowchart showing steps before the start of an initial rotation in the embodiment 2.
Figure 8:
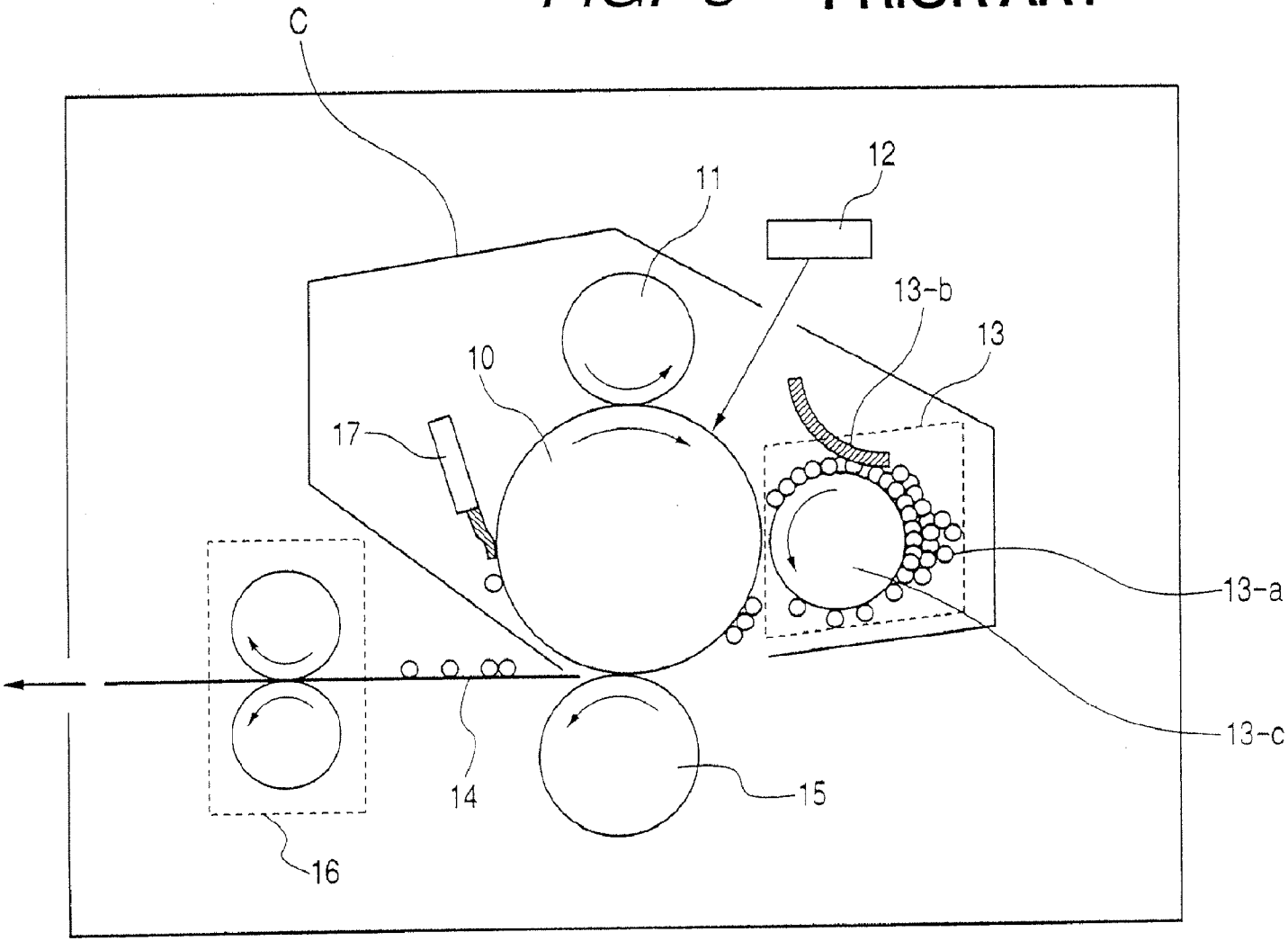
FIG. 8 PRIOR ART
FIG. 8 is a view showing a prior image forming apparatus.
Figure 9:
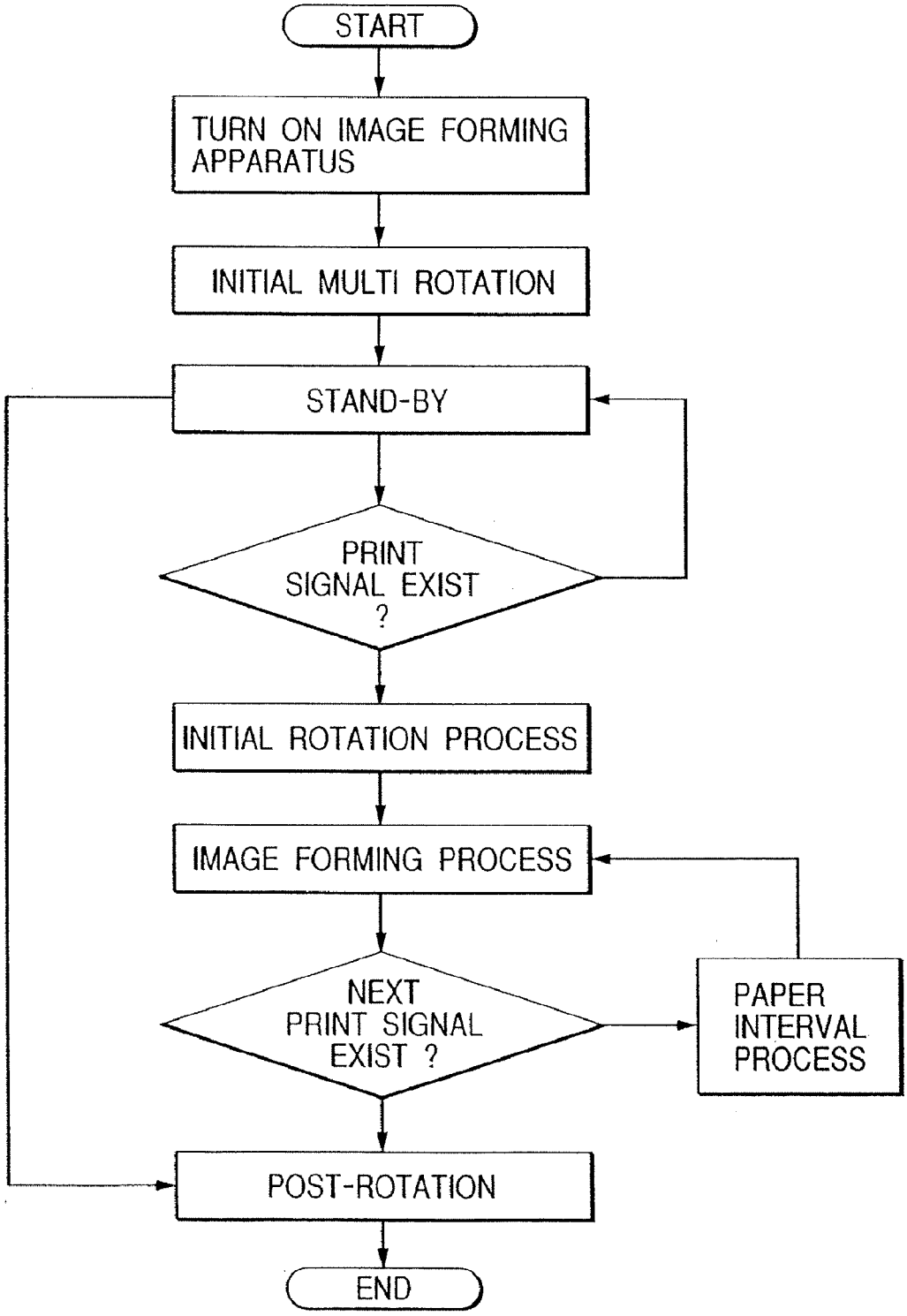
PRIOR ART FIG. 9
FIG. 9 is a flowchart showing an operation sequence of the prior image forming apparatus.
Figure 10:
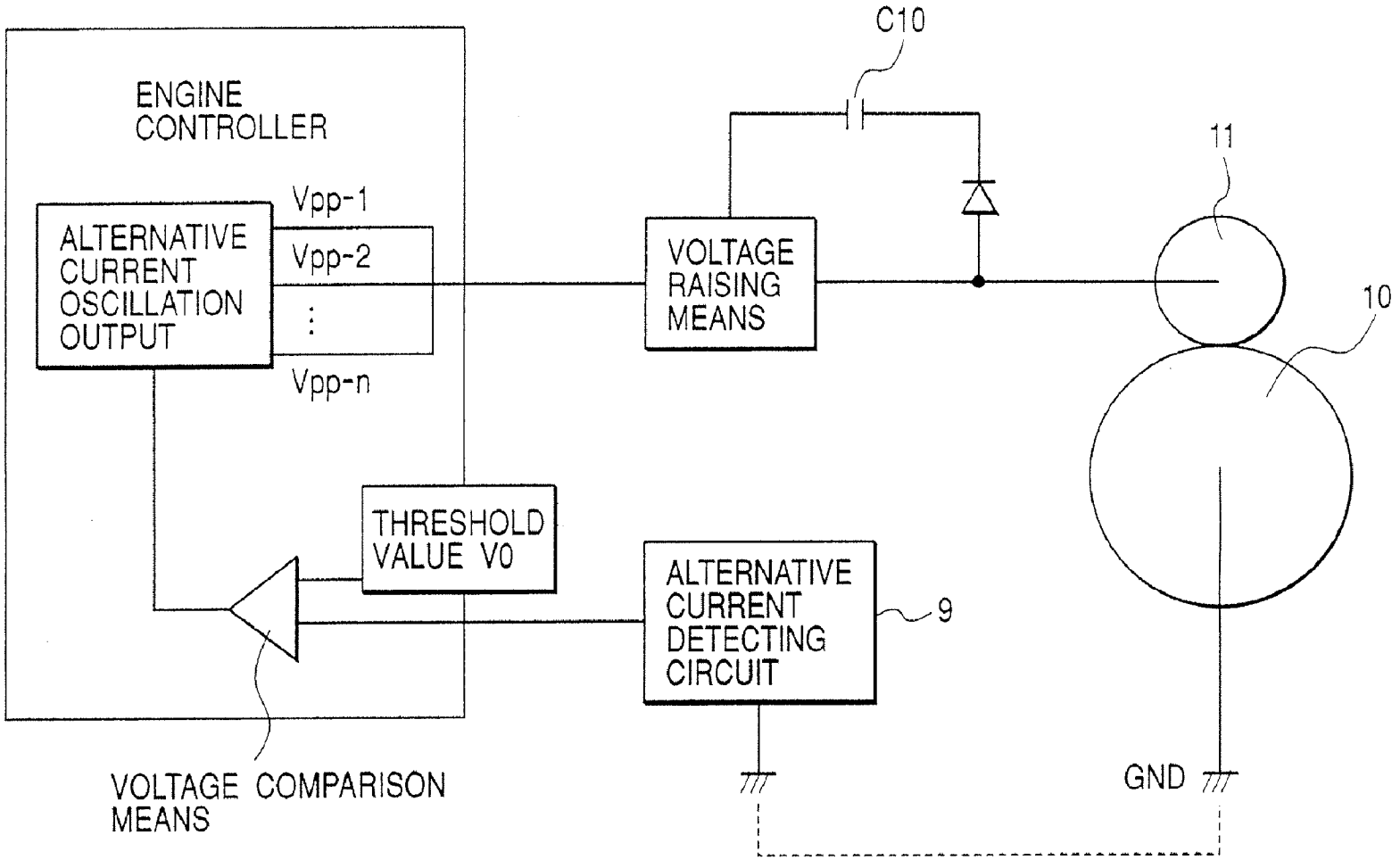
PRIOR ART FIG. 10
FIG. 10 is a view showing a charging bias supply circuit in a peak-to-peak voltage selection for a charging AC voltage.
Figure 11:
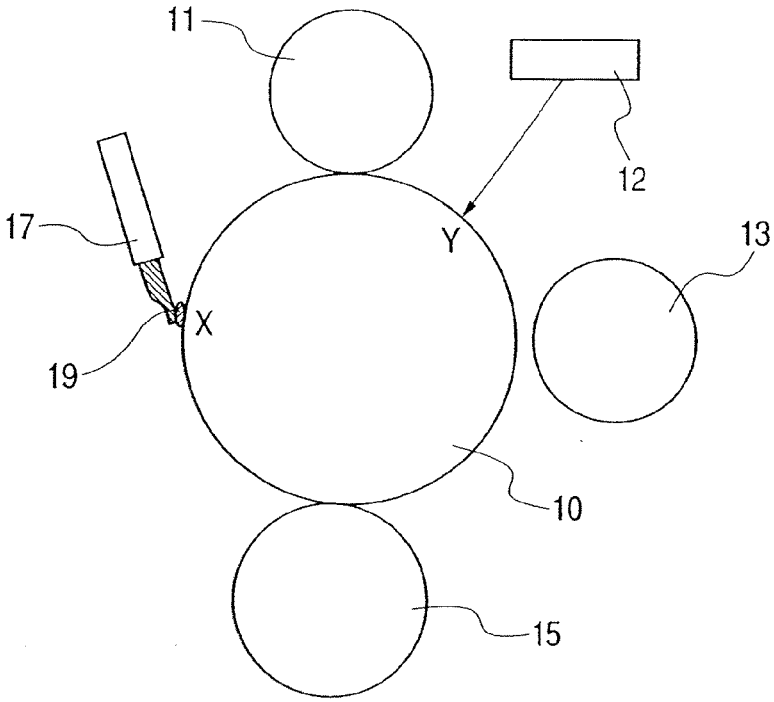
PRIOR ART FIG. 11
FIG. 11 is a view showing a white streak image resulting from a foreign substance deposited on the surface of the photosensitive (view No. 1)
Figure 12:
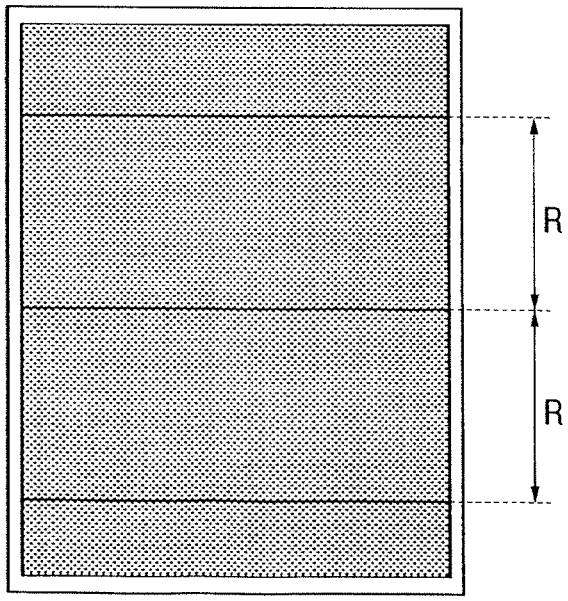
FIG. 12 is a view showing a white streak image resulting from a foreign substance deposited on the surface of the photosensitive (view No. 2)

FIGS. 7A and 7B show an operation sequence chart of a main motor, a charging and a transfer of the image forming apparatus of the present embodiment, and a flow chart thereof, respectively in a mode with an ordinary transfer material and in an initial rotation extending mode for example in case of passing a thick paper as explained above.

Referring to FIG. 7B, when the user of the image forming apparatus determines a print mode for example depending on the kind of the transfer material and turns on a print signal, a fixing temperature of the fixing apparatus is determined in the main body of the image forming apparatus, according to thus determined print mode.

Then, there is discriminated whether such fixing temperature can be processed in the initial rotation time of the normal mode. In case the initial rotation time of the normal mode is enough, a charging bias application time in the initial rotation step is set at T6+T7, which is a charging bias application time of a normal initial rotation mode as shown in FIG. 7A, and the initial rotation is initiated.

On the other hand, in case the initial rotation time requires an extension, the main body of the image forming apparatus determines a time T8 necessary for regulating the temperature of the fixing device as shown in FIG. 7B, then sets the charging bias application time at T6+T7+T8, and initiates the initial rotation.

When the initial rotation is started, as to the charging bias, a peak-to-peak voltage selecting bias is applied at first, and a foreign substance eliminating bias is applied later. The applications in such sequence are to prevent a charging failure in the image formation, as already explained in the embodiment 1.

Also a peak-to-peak voltage selecting bias is applied for a time T6 same as in the normal mode (corresponding to one turn of the photosensitive drum), and a peak-to-peak voltage of a maximum applicable AC voltage (foreign substance eliminating bias) is applied for a time of T7+T8, which is extended by T8 from the case of the normal mode. In this manner, the surface of the photosensitive drum has more opportunities of polishing immediately before the image formation, and is more refreshed at the image formation, thereby enabling a satisfactory image formation.

Also in case of executing ATVC control or the like as in the embodiment 2, the weak bias application for ATVC control is extended for T8. Since an application of a strong positive voltage such as a print bias to the photosensitive drum may generate a memory on the surface thereof by a positive charging, the application of the print bias is preferably executed at S14 immediately before the image formation, thereby minimizing the time of application of such high positive voltage.

Embodiment 4

This embodiment defines a discharged charge amount caused by the foreign substance eliminating bias employed in the embodiments 1 to 3, thereby improving a foreign substance eliminating property on the drum surface. Other configurations are the same as those in the embodiment 1 and therefore will not be explained further.

(1) Discharged Charge Amount δ Per Unit Area

There will be given an explanation on a discharged charge amount δ(μA×sec $m^2$) (hereinafter δ being simply represented as discharged charge amount). Also an "AC charge amount ρ per unit area (μA×sec/$m^2$)" is an amount defined by:

$$\rho[\mu A\times\text{sec}/m^2]=Iac/L/Vps$$

wherein Iac (μA) is a current flowing in the photosensitive drum, Vps (m/sec) is a moving speed of the photosensitive drum, and L (m) is a longitudinal length of a charging area, and it is hereinafter simply represented as the AC charge amount.

Figure 15:
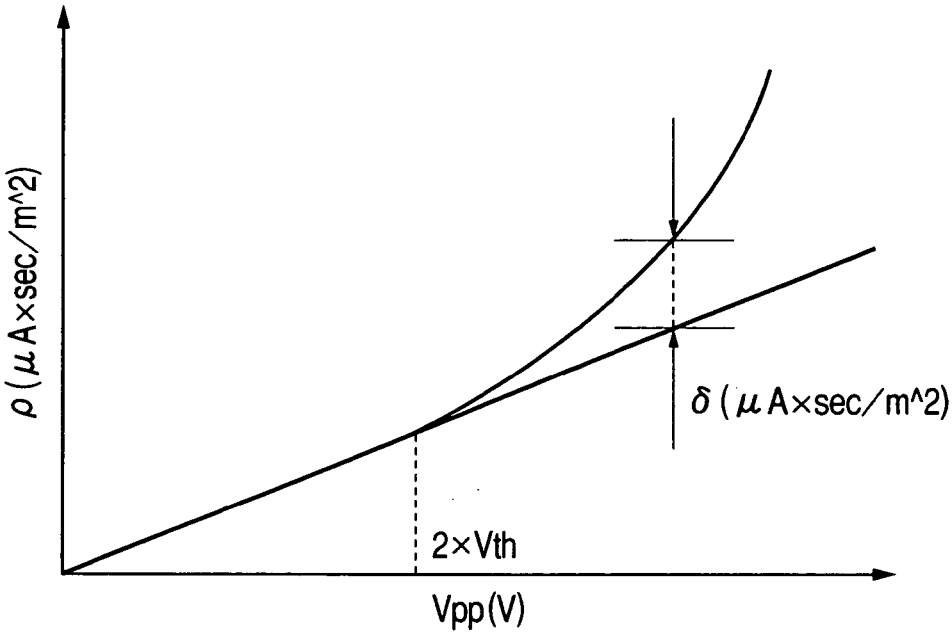
FIG. 15 is a chart showing general AC voltage-current characteristics in a state where a contact charging roller is in contact with a photosensitive drum.

Referring to FIG. 15 showing general charging characteristics of a charging roller between a peak-to-peak voltage Vpp (V) of a vibrating component represented on the abscissa and an AC charge amount ρ (μA×sec/$m^2$) represented on the coordinate, the AC charge amount ρ increases linearly within a range of Vpp from zero to a twice of a charging start voltage Vth. An inclination of this linear line indicates an AC admittance. In a region beyond twice of Vth, the relationship of the two is no longer linear and the inclination increases with an increase in Vpp. Such increase in the inclination is due to an increase in the AC charge amount ρ cause by the start of a discharge.

Therefore, the discharged charge amount δ at a peak-to-peak voltage Vpp of the applied voltage in a region beyond twice of Vth is represented by:

$$\delta[\mu A\times\text{sec}/m^2]=(Iac-\alpha\times Vpp)/L/Vps$$

wherein α represents an AC admittance, which is a ratio of current to a voltage not exceeding twice of the discharge starting voltage Vth.

(2) Discharged Charged Amount and Polishing Effect for the Surface of Photosensitive Drum As explained in the foregoing, an increase in the discharged charge amount to the photosensitive drum facilitates a cleavage of a chain connecting molecules on the surface of the photosensitive drum. Consequently a resin constituting the surface of the photosensitive drum is modified toward a lower molecular weight, and becomes more easily scrapable with the cleaning blade. Since the discharge current and the discharged charge amount have a positive correlation, an increase in the polishing effect on the surface of the photosensitive drum can be achieved by applying a larger discharged charge amount δ on the surface of the photosensitive drum, thereby facilitating the scraping of the surface.

However, in case an excessively high discharged charge amount continues to be applied to the surface of the photosensitive drum, a scraping speed of the surface layer of the photosensitive drum increases in the course of continued use of the apparatus, and the photosensitive layer upon reaching a limit thickness loses its function thereby generating a local charging unevenness or a charging failure as a result of a decrease in the charge holding ability of the surface. Consequently the service life of the image forming apparatus and the process cartridge is limited by a number of prints until the photosensitive layer is abraded to the limit film thickness.

Figure 16:
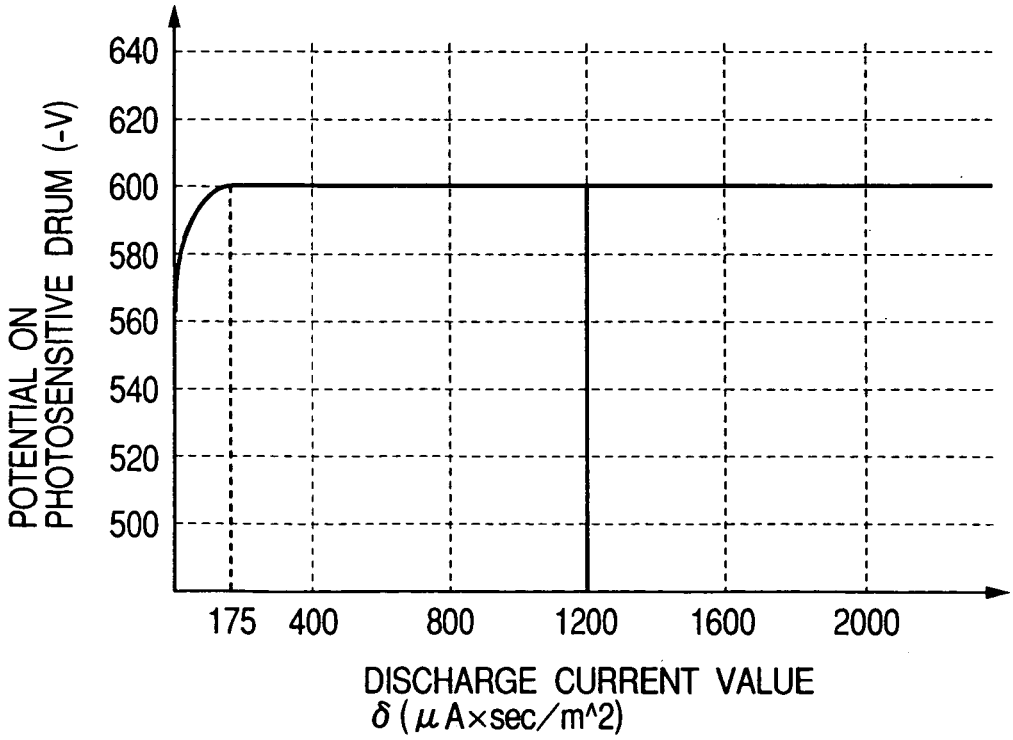
FIG. 16 is a chart showing a relationship between a discharge current and a potential on a photosensitive drum.

FIG. 16 shows a relationship between a discharged charge amount δ and a surface potential Vd of the photosensitive drum, found experimentally by the present inventors.

The surface potential Vd of the photosensitive drum, as a function of the discharged charge amount δ per unit area (μA×sec/m$^2$), is stabilized from 175 (μA×sec/m$^2$), but a range of 175 to 1200 (μA×sec/m$^2$) is undesirable for selection as a discharged charge amount of the charging AC voltage for charging the image forming area, because of presence of local spot-shaped weakly charged portions, which appear as black spots or white spots on the image. In a range of δ beyond 1200 (μA×sec/m$^2$), such weakly charged portions disappear so that the photosensitive drum can be uniformly charged.

Therefore, the discharged charge amount δb of the charging AC voltage for charging an area to constitute an image forming area is preferably selected larger than 1200 (μA×sec/m$^2$) but as close as possible to 1200 (μA×sec/m$^2$).

(3) Control Mechanism

In the present embodiment, control is made on the discharged charge amount of the foreign substance eliminating bias of the embodiment 1 and the discharged charge amount of the charging AC voltage.

Figure 17:
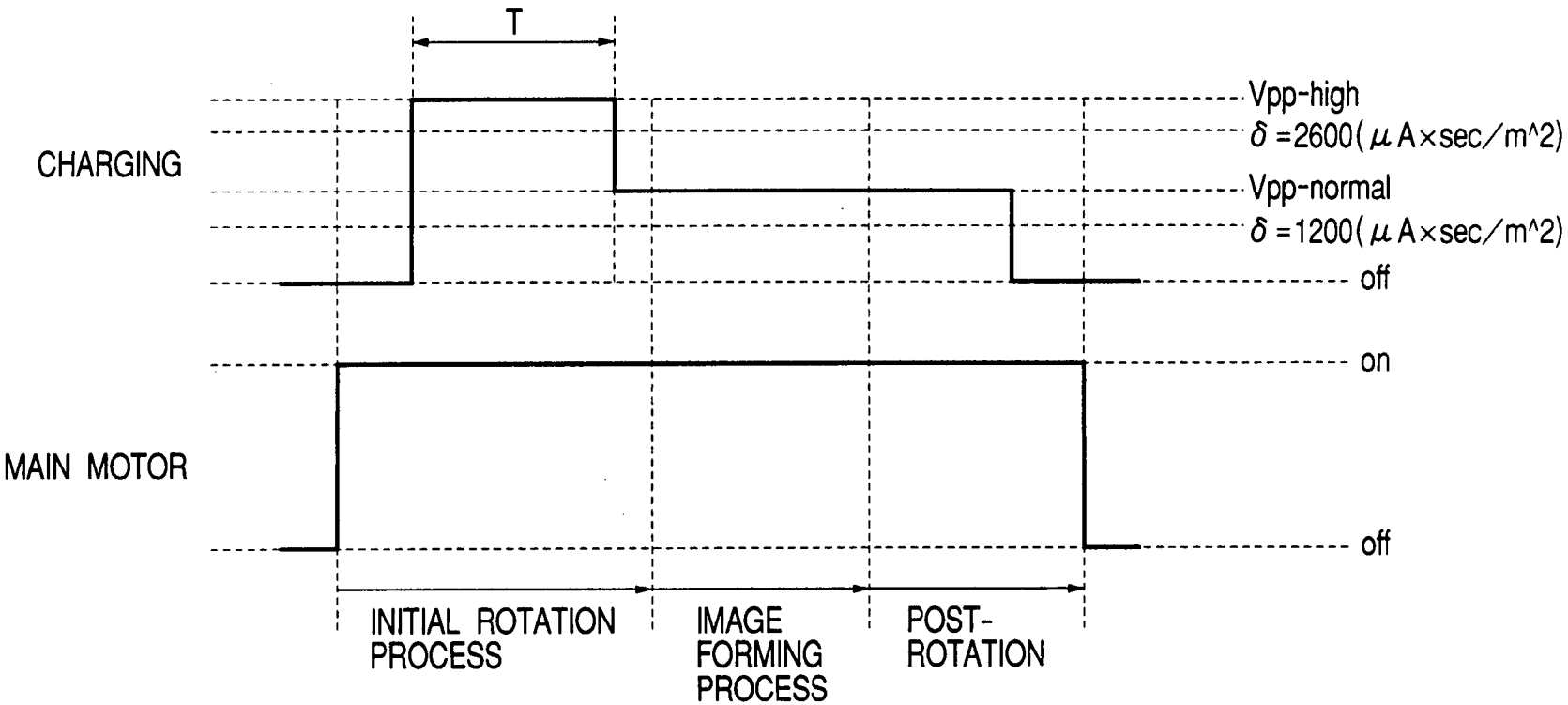
FIG. 17 is a chart showing a charging sequence in an embodiment 4.

Referring to FIG. 17 showing a charging bias applying sequence of the embodiment 4 of the present invention (however excluding the peak-to-peak voltage selecting step), the initial rotation step is provided with a sequence T for applying the foreign substance eliminating bias to the photosensitive drum, and a discharged charge amount δa during this sequence T is larger than a discharged charge amount δb during a printing process. This is intended to apply a strong discharge to the photosensitive drum in the initial rotation step, thereby increasing the polishing effect for the surface of the photosensitive drum immediately before the image formation and securely eliminating the foreign substance. Therefore, the foreign substance eliminating sequence is so designed that a portion to be subjected to foreign substance elimination passes the charging roller at least once.

Also in this sequence, there is calculated in advance a relation between the AC charge amount ρ and the discharged charge amount δ, and such an AC voltage as to obtain an appropriate discharged charge amount is applied.

(4) Evaluation

Following experiment was executed in order to confirm the effect of the present sequence.

Experiment 1

Experiment for confirming a foreign substance eliminating ability on the surface of the photosensitive drum A portion with deposited foreign substance was made to pass through the charging roller three times, under following conditions, during the sequence T of application of the foreign substance eliminating bias, and a number of white streaks generated at an interval of the periphery of the photosensitive drum, on a halftone image (1 dot-1 space lateral line: resolution 600 dpi).

Conditions environment: high temperature and high humidity (room temperature 35° C., 85% RH)
photosensitive drum moving speed Vps: 130 (mm/sec)
resolution of main body of image forming apparatus: 600 (dpi)
charging bias voltage: AC current control
AC current Iac of foreign substance eliminating bias: 600–850 (μA)
discharged charge amount δa of foreign substance eliminating bias: 1280–5400 (μA×sec m$^2$).
AC current Iac' of charging AC voltage: 600 (μA)
discharged charge amount δb of charging AC voltage: 1280 (μA)
charging AC frequency f: 900 (Hz)
photosensitive drum diameter ϕ: 28 (mm)
surface layer of photosensitive drum: polycarbonate resin with an average molecular weight M=15000, in which a charge transporting agent is dispersed
contact pressure of cleaning blade to photosensitive drum: 40 (gf/cm)
transfer material: a transfer material of a longitudinal length×transversal length=1500×216 (mm) being passed Result of Experiment 1 (Embodiment 4-a)

Figure 18:
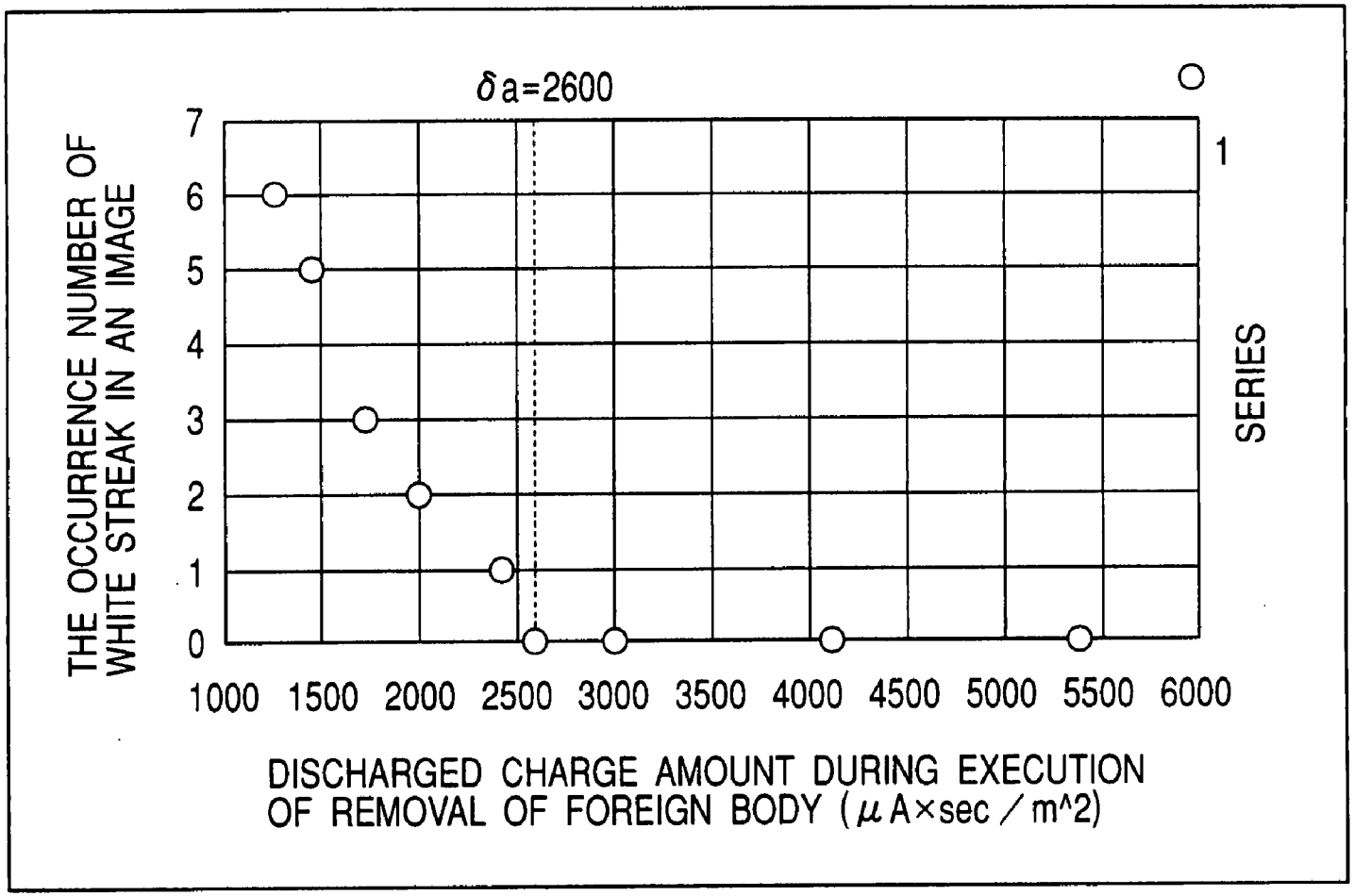
FIG. 18 is a graph showing an experimental result for a foreign substance eliminating effect in the embodiment 4.

In FIG. 18, the abscissa indicates a discharged charge amount δa per unit area during the sequence T for applying the foreign substance eliminating bias, and the ordinate indicates a number of white streaks appearing on the image.

These results confirmed a significant effect, as a larger discharged charge amount δa increased the polishing effect on the photosensitive drum to achieve a faster vanishing of the white streaks, and particularly as the white streak generation could be completely avoided in a range δa≧2600 (μA×sec/m$^2$).

Also an increase in the average molecular weight M of the surface of the photosensitive drum renders the scraping more difficult, thereby rending the removal of the foreign substance more difficult, but the drum surface can be satisfactorily polished in a range of the average molecular weight of the surface of the photosensitive drum M≦40000, whereby the effect of the foreign substance eliminating sequence of the present embodiment appears clearly.

Experiment 2

Experiment for confirming a service life of the photosensitive drum

A service life of the photosensitive drum was confirmed under following conditions. The service life of the photosensitive drum is defined by a timing when the surface of the photosensitive drum cannot be fully charged by a surface scraping of the photosensitive drum thereby resulting in so-called fog phenomenon in which a toner development is generated in a solid white image portion.

[Conditions-1 (Embodiment 4-b)]

environment: high temperature and high humidity (room temperature 35° C., 85% RH)
photosensitive drum moving speed Vps: 130 (mm/sec)
resolution of main body of image forming apparatus: 600 (dpi)
charging bias voltage: AC constant current control
AC current Iac of foreign substance eliminating bias: 750 (μA)
discharged charge amount δa of foreign substance eliminating bias: 3260 (μA×sec/m$^2$)
AC current Iac' of charging AC voltage: 600 (μA)
discharged charge amount δb of charging AC voltage: 1280 (μA)
charging AC frequency f: 900 (Hz)
photosensitive drum diameter ϕ: 28 (mm)
surface layer of photosensitive drum: average molecular weight M=15000
contact pressure of cleaning blade to photosensitive drum: 40 (gf/cm)
evaluation mode: intermittent durability test by one sheet each

[Conditions-2 (Comparative Example 4-1)]

AC current of charging AC voltage: 600 (μA: constant)
discharged charge amount δb of charging AC voltage: 1280 (μA×sec/m$^2$: constant)

Other conditions are same as those in condition-1.

[Conditions-3 (Comparative Example 4-2)]

AC current Iac' of charging AC voltage: 750 (μA: constant)

discharged charge amount δb of charging AC voltage: 3260 (μA×sec/$m^2$: constant)

Other conditions are same as those in condition-1.

Results of Experiment 2

FIG. 19 shows the results of the experiment 2. In a case with the sequence of the present embodiment, the photosensitive drum reached the end of the service life at 7000 sheets. On the other hand, the comparative example 1 with the least discharged charge amount showed the end of the service life at 7300 sheets. Also the comparative example 2 with the largest discharged charge amount showed the end of the service life at 5400 sheets.

These results indicate that the present embodiment does not shorten the service life of the photosensitive drum since the discharged charge amount is made larger only in a necessary portion.

In the configuration explained in the foregoing, a sequence for applying a foreign substance eliminating bias in a necessary portion is provided in the initial rotation step, thereby increasing the discharged charge amount in such portion, whereby the surface of the photosensitive drum is refreshed immediately before the image formation and does not generate an image defect resulting from a foreign substance deposited on the surface of the photosensitive drum.

Also a portion where the discharge current is increased is limited, whereby the surface of the photosensitive drum is not scraped off unnecessarily and the service life thereof is not shortened.

What is claimed is:

1. An image forming apparatus comprising:

a rotatable latent image bearing member for bearing a latent image;

charging means contacting with said latent image bearing member and being provided with a voltage applied thereto for charging said latent image bearing member;

cleaning means contacting with said latent image bearing member and being adapted to clean said latent image bearing member; and transfer means contacting with said latent image bearing member and being provided with a transfer voltage for transferring, to a transfer medium, a developer image developed with a developer in an image forming area, wherein said charging means, when in contact with an area constituting a non-image forming area of said latent image bearing member, is provided with an AC voltage for charging the non-image forming area having a peak-to-peak voltage larger than a peak-to-peak voltage of a charging AC voltage applied to said charging means for charging an area constituting the image forming area, wherein when an area of said latent image bearing member, charged by said AC voltage for charging the non-image forming area applied to said charging means, comes into contact with the transfer means, a DC voltage of a polarity opposite to a normal charging polarity of said latent image bearing member is applied to said transfer means, and wherein the transfer voltage is determined based on the DC voltage.

2. An image forming apparatus according to claim 1, wherein a peak-to-peak voltage of the AC voltage for the non-image forming area is a maximum peak-to-peak voltage among the peak-to-peak voltages applied to said charging means.

3. An image forming apparatus according to claim 1, wherein the AC voltage for charging the non-image forming area is applied to said charging means during a time equal to or longer than a time of one rotation of said latent image bearing member.

4. An image forming apparatus according to claim 1, further comprising a power supply circuit, wherein said power supply circuit outputs an AC and DC superposed voltage to said charging means by single voltage-elevating means.

5. An image forming apparatus comprising:

a rotatable latent image bearing member for bearing a latent image;

charging means contacting with said latent image bearing member and being provided with a voltage applied thereto for charging said latent image bearing member;

cleaning means contacting with said latent image bearing member and being adapted to clean said latent image bearing member;

AC current detecting means capable, when the voltage is applied to said charging means, of detecting an AC current flowing in said charging means and said latent image bearing member; and transfer means contacting with said latent image bearing member and being provided with a transfer voltage for transferring, to a transfer medium, a developer image developed with a developer in an image forming area, wherein said charging means, when in contact with an area constituting an non-image forming area of said latent image bearing member, is provided with an AC voltage for charging the non-image forming area having a peak-to-peak voltage larger than a peak-to-peak voltage of a charging AC voltage applied to said charging means for charging an area constituting the image forming area, wherein when an area of said latent image bearing member, charged by said AC voltage for charging the non-image forming area applied to said charging means, comes into contact with the transfer means, a DC voltage of a polarity opposite to a normal charging polarity of said latent image bearing member is applied to said transfer means, and wherein the transfer voltage is determined, based on a current flowing between said latent image bearing member and said transfer means when the DC voltage is applied to said transfer means.

6. An image forming apparatus according to claim 5, wherein a peak-to-peak voltage of the AC voltage for the non-image forming area is a maximum peak-to-peak voltage among the peak-to-peak voltages applied to said charging means.

7. An image forming apparatus according to claim 5, wherein the AC voltage for charging the non-image forming area is applied to said charging means during a time equal to or longer than a time of one rotation of said latent image bearing member.

8. An image forming apparatus according to claim 5, further comprising a power supply circuit, wherein said power supply circuit outputs an AC and DC superposed voltage to said charging means by single voltage-elevating means.

* * * * *

UNITED STATES PATENT AND TRADEMARK OFFICE

CERTIFICATE OF CORRECTION

PATENT NO. : 7,174,112 B2
APPLICATION NO. : 11/326188
DATED : February 6, 2007
INVENTOR(S) : Satoru Motohashi et al.

It is certified that error appears in the above-identified patent and that said Letters Patent is hereby corrected as shown below:

ON THE TITLE PAGE:
At Item (56), Right Column, Foreign Patent Documents, Page 2, "2000010364 A" should read --2000-010364 A--.

IN THE DRAWINGS:
Sheet No. 19,Figure 18, "STREAK" should read --STREAKS--.

COLUMN 1:
Line 9, "divisional" should read --divisional of--.
Line 46, "apparatus. When" should read --apparatus. ¶ When--.
Line 56, "moves" should read --moves to--.
Line 63, "stan-up" should read --start-up--.
Lines 66 through 67 should be deleted.

COLUMN 2:
Lines 1 through 9 should be deleted.
Line 62, "cleav-" should read --clean- --.

COLUMN 3:
Line 55, "photosensitive" should read --photosensitive drum--.
Line 61, "a," should read --a--.

COLUMN 4:
Line 16, "a," should read --a--.

COLUMN 5:
Line 53, "flow chart" should read --flowchart--.

COLUMN 6:
Line 3, "photosensitive" should read --photosensitive drum--.

COLUMN 8:
Line 37, close the right margin, and
Line 38, close the left margin, so that the two paragraphs are combined.

COLUMN 10:
Line 22, "<Vpp-(+1)<Vpp-n<Vpp-(–l ))." should read
--<Vpp-(n+1)<Vpp-n<Vpp-(–l)).--.
Line 45, "step" should read --a step--.

UNITED STATES PATENT AND TRADEMARK OFFICE

CERTIFICATE OF CORRECTION

PATENT NO. : 7,174,112 B2
APPLICATION NO. : 11/326188
DATED : February 6, 2007
INVENTOR(S) : Satoru Motohashi et al.

It is certified that error appears in the above-identified patent and that said Letters Patent is hereby corrected as shown below:

COLUMN 11:
Line 20, “control).” should read --control,--.
Line 36,“control).” should read --control.--.
Line 47, “control),” should read --control,--.

COLUMN 12:
Line 42, “of” (second occurrence) should read --or--.
Line 50, “deposited” should read --is deposited--.
Line 51, “becoming” should read --becomes--.
Line 52, “is” should read --it is--.

COLUMN 13:
Line 62, “4-2))” should read --4-2)--.

COLUMN 15:
Line 59, “a,” should read --a--.

COLUMN 16:
Line 52, “extended” should read --extended more--.
Line 56, “not,” should read --not--.

COLUMN 17:
Line 19, “case” should read --a case--.

COLUMN 20:
Line 25, “rending” should read --rendering--.

UNITED STATES PATENT AND TRADEMARK OFFICE

CERTIFICATE OF CORRECTION

PATENT NO. : 7,174,112 B2
APPLICATION NO. : 11/326188
DATED : February 6, 2007
INVENTOR(S) : Satoru Motohashi et al.

It is certified that error appears in the above-identified patent and that said Letters Patent is hereby corrected as shown below:

COLUMN 22:
Line 32, "an" should read --a--.

Signed and Sealed this

Twenty-first Day of August, 2007

JON W. DUDAS
*Director of the United States Patent and Trademark Office*